US009891589B2

(12) United States Patent
Leigh-Bramwell et al.

(10) Patent No.: US 9,891,589 B2
(45) Date of Patent: Feb. 13, 2018

(54) BAROMETER CLOCK

(71) Applicant: Bramwell Brown Limited, London (GB)

(72) Inventors: Rob Leigh-Bramwell, London (GB); Sarah Leigh-Bramwell, London (GB)

(73) Assignee: Bramwell Brown Limited, London (GB)

( * ) Notice: Subject to any disclaimer, the term of this patent is extended or adjusted under 35 U.S.C. 154(b) by 0 days.

(21) Appl. No.: 15/299,965

(22) Filed: Oct. 21, 2016

(65) Prior Publication Data

US 2017/0038735 A1 Feb. 9, 2017

Related U.S. Application Data

(63) Continuation of application No. PCT/GB2015/051773, filed on Jun. 17, 2015.

(30) Foreign Application Priority Data

Jun. 17, 2014 (GB) ..... 1410779.1

(51) Int. Cl.
*G04B 47/06* (2006.01)

(52) U.S. Cl.
CPC ..... *G04B 47/06* (2013.01); *G04B 47/066* (2013.01)

(58) Field of Classification Search
CPC ..... G04B 47/06; G04B 47/066
See application file for complete search history.

(56) References Cited

U.S. PATENT DOCUMENTS

| | | | | | |
|---|---|---|---|---|---|
| 1,913,481 | A * | 6/1933 | Gody | G04B 47/066 | 368/11 |
| 2,510,402 | A * | 6/1950 | Johnston | G01L 27/02 | 368/11 |
| 2,716,327 | A * | 8/1955 | Franklin | G04B 47/066 | 116/266 |
| 5,500,835 | A * | 3/1996 | Born | G04C 3/146 | 368/11 |

FOREIGN PATENT DOCUMENTS

| | | |
|---|---|---|
| BE | 424295 | 11/1937 |
| CH | 703821 | 3/2012 |
| DE | 3913275 | 8/1990 |

* cited by examiner

*Primary Examiner* — Vit W Miska
(74) *Attorney, Agent, or Firm* — Beyer Law Group LLP

(57) ABSTRACT

A barometer clock includes a clock face, a clock mechanism, and a spindle located in the face and driven by the mechanism. A barometer mechanism includes a barometric sensor, drive means and drive shaft and a plurality of display members located behind the clock face, each member engaged to the drive shaft by a gear mechanism and rotatable by the shaft in response to a signal by the barometric sensor. The clock face includes an aperture, each display member being rotatable between a respective visible location wherein the display member may be observed through the aperture and a hidden location wherein the display member is concealed by the clock face. The gear mechanisms are adapted to successively move the display members between hidden and visible locations as the drive shaft rotates to provide a display characteristic of weather conditions associated with pressure conditions measured by the barometric sensor.

14 Claims, 36 Drawing Sheets

BAROMETER CLOCK

CROSS-REFERENCE TO RELATED APPLICATIONS

This Application claims priority to Application No. PCT/GB2015/051773, filed on Jun. 17, 2015, and GB Application No. 1410779.1, filed on Jun. 17, 2014, both of which are incorporated herein in their entirety for all purposes.

This invention relates to a barometer clock of the kind which combines the functions of a barometer and clock into an integral device.

Conventional barometer clock arrangements comprise separate barometer and clock mechanisms mounted in an integral case. Typically generally cylindrical clock and barometer mechanisms may be mounted side by side in a wooden case so that the two mechanisms operate entirely separately but can be viewed simultaneously.

According to the present invention a barometer clock comprises a clock face, a clock mechanism comprising, a spindle located in the face and driven by the mechanism and rotatable hands mounted on the spindle to provide a time display;

a barometer mechanism comprising, a barometric sensor, drive means and drive shaft and a plurality of display members located behind the clock face, each member engaged to the drive shaft by a gear or pulley mechanism and rotatable by the shaft in response to a signal by the barometric sensor;

wherein the clock face includes an aperture, each display member being rotatable between a respective visible location wherein the display member may be observed through the aperture and a respective hidden location wherein the display member is concealed by the clock face;

wherein the gear mechanisms are adapted to successively move the display members between hidden and visible locations as the drive shaft rotates to provide a display characteristic of weather conditions associated with pressure conditions measured by the barometric sensor.

The initial angular location or starting point and rate and direction of rotation of each display during rotation of the shaft are preferably selected so that continuous rotation of the shaft between a minimum pressure orientation and a maximum pressure orientation causes movement of the display members between successive hidden, visible and optionally second hidden locations to provide a constantly variable display observable through the aperture in the clock face.

Each display member may occupy a sector of the clock circumference. Each display is preferably annular, occupying a sector in the circular clock face but not obscuring an observer's view through an aperture in a central portion of the face. This enables the gear mechanism to be observed.

Each sector may have a leading edge which is brought into view as the display moves from a hidden to a visible location.

The aperture may comprise a sector of the clock face, for example extending across an angle of 60° to 120°, preferably about 90°.

The leading edge may be shaped to form a silhouette of a weather feature, for example a cloud, sun, lightning or rain feature. The display member may be perforated to allow a user to observe an underlying display.

A multiplicity of displays may be arranged in overlying axially spaced relation on the drive shaft. A first display may over lie and partially or wholly conceal a second display.

The displays are laminar and may comprise flat plates or sheets having a decorated surface facing towards the aperture, the decorated surface representing a weather condition.

The displays may comprise annular portions mounted on a circular, circumferential support. The support may comprise bearings, for example roller bearings.

In a preferred embodiment three rotatable displays are employed, each representing for example: storm, rain cloud, and light cloud weather conditions. The displays may be mounted on guides or pairs of rollers arranged to facilitate alignment of the displays during assembly.

The face may include a second aperture arranged to display wording, for each of several weather conditions, for example, "dry" "stormy", "rain" or "fair". This wording may be provided on an appropriate portion of the storm display arranged to be visible through the aperture when the display is rotated by a predetermined angle so that the wording corresponds to the visible display.

The drive mechanism may comprise a planetary or epicyclic gear and an optional pulley and belt arrangement for each display member. The gear or pulley arrangement may comprise a sun gear or pulley and one or two planetary gears or pulleys engaging an orbital gear or pulley located on the annular surface of the display member or connected to the display member. A single planetary gear or pulley may be provided to cause the respective display member to rotate anti-clockwise as the stepper motor moves from the rest position to the fully extended position. A chain of two planetary gears or pulleys may be used to cause the display member to rotate in opposite direction, clockwise simultaneously with the anti-clockwise rotation of the other members.

The drive shaft may be hollow to coaxially accommodate the clock spindle.

A single electric motor may be provided to drive the barometric display, for example a stepper motor may be employed.

The barometric sensor may include a processor adapted to calculate the ratio of pressure change to pressure.

The barometric sensor preferably adapted to measure air pressure and provide a signal after successive time periods, for example, once an hour. The sensor may include a memory to store data for a number of successive periods, for example, 48 hours. The sensor further includes a processor adapted to deter pressures over successive periods and to provide a signal indicating whether the pressure is stable or changing. Pressure at each time period is allocated to a pressure band. The pressure may be indicative of particular weather conditions, for example, fair, very dry, changeable, rainy and stormy.

The rate of change is determined. If the pressure is determined to be changing, a signal is sent to the drive motor to display "change". If the pressure is changing rapidly the signal is sent to the motor to display "stormy" or if the pressure is rapidly rising a signal is sent to display "passing". Separation of the pressure in two bands, enabling each band as indicative of pressures for a particular weather condition, enables the rate of change of pressure to be conveniently measured.

In an alternative embodiment, the pressure is determined to be changing, a signal is sent to the drive motor to display "fast increase". If the pressure is changing rapidly the signal is sent to the motor to display "fast decrease" or if the pressure is rapidly rising a signal is sent to display "passing". The pressure may be indicative of further conditions, for example, slow fall, slow raise and static. Separation of the pressure in two bands, enabling each band as indicative of pressures for a particular weather condition, enables the rate of change of pressure to be conveniently measured.

The barometer clock of the present invention confers numerous advantages. An integral display of time and weather conditions is provided in an efficient and attractive arrangement. The drive mechanism provides efficient and accurate means for controlling the motion of the display while affording an attractive appearance.

The measurement of pressure in bands allows simply manipulation of the rate of change of pressure, permitting the visual display to be controlled automatically in contrast to a conventional barometer.

The invention is further described with means of example but not in any limitative sense with reference to the accompanying drawings of which:

Figure 22:
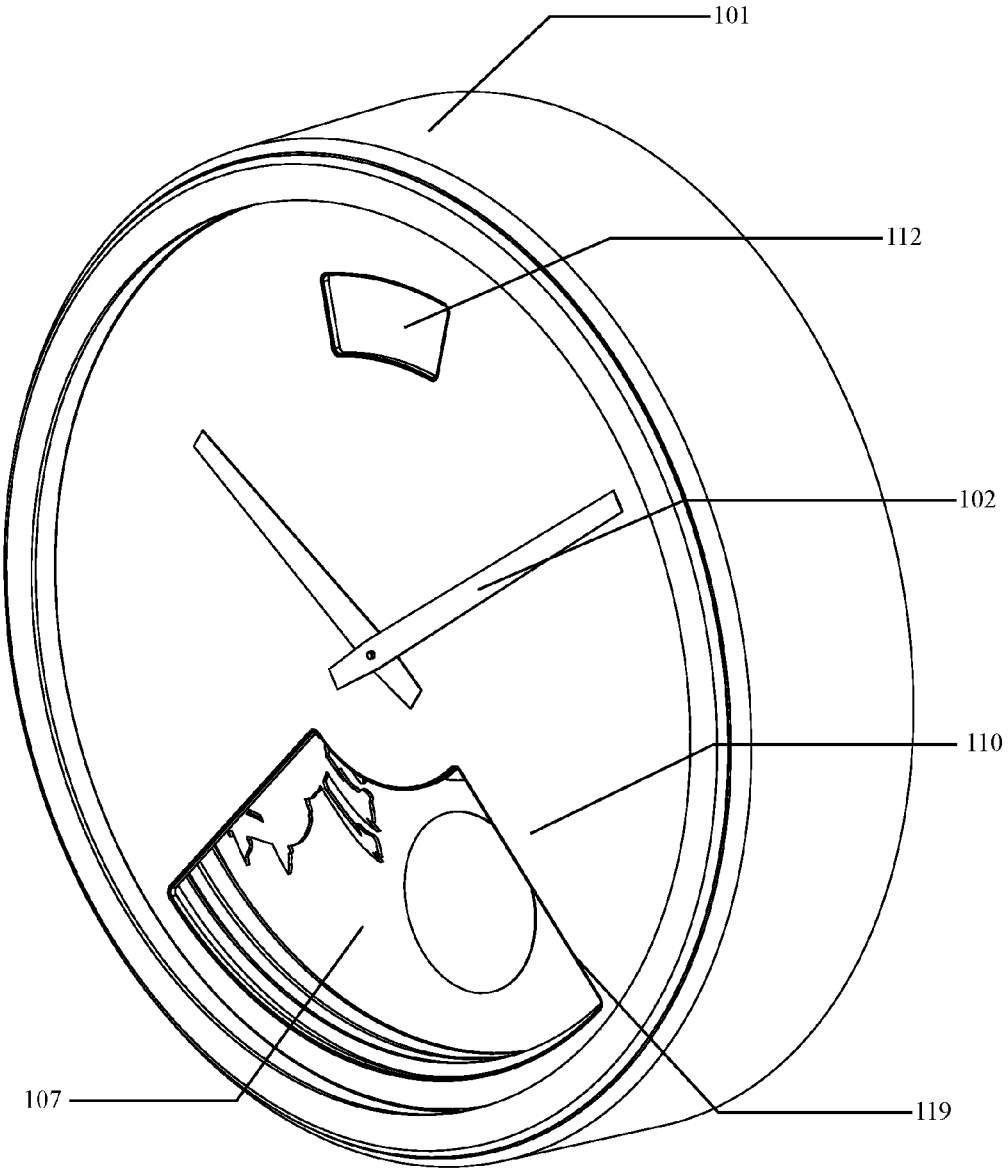
Figure 28:
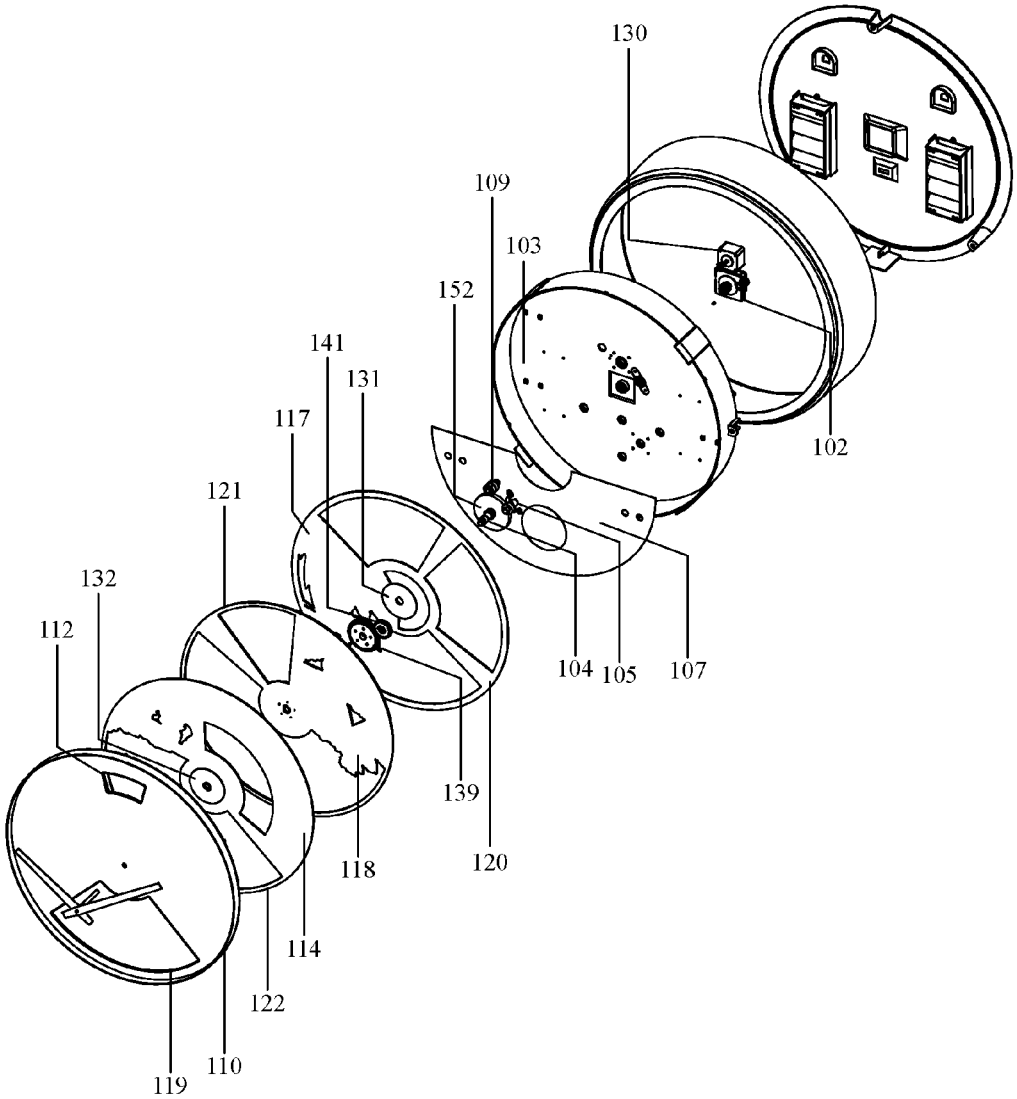
Figure 29:
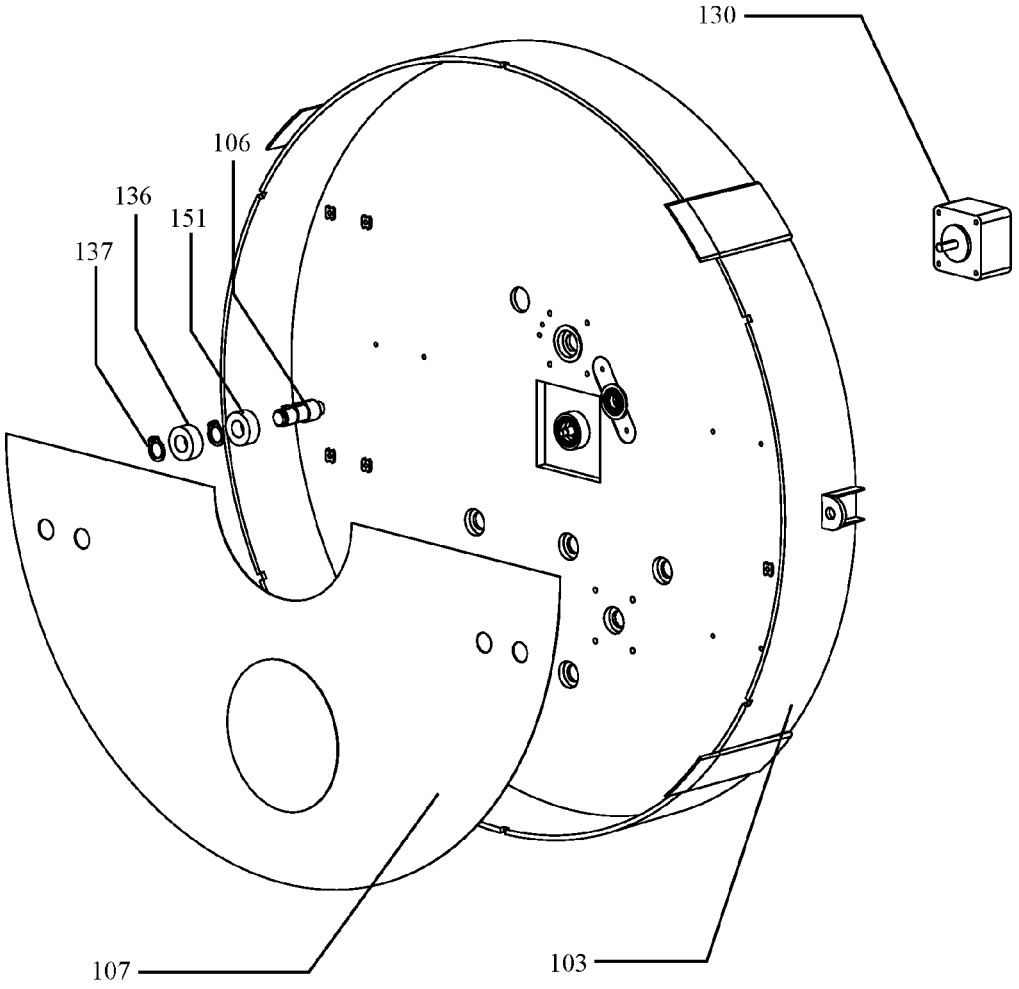
Figure 30:
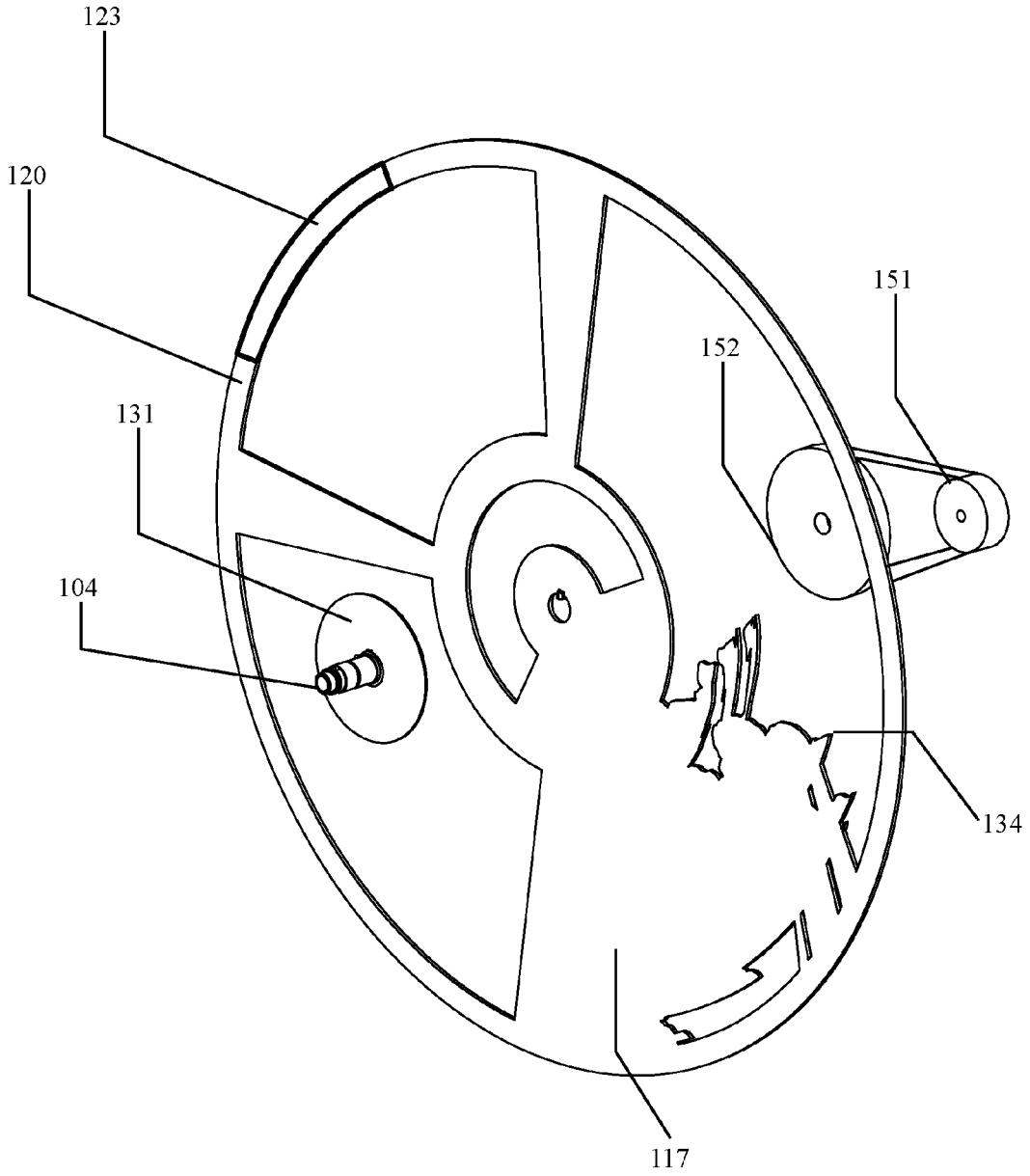
Figure 31:
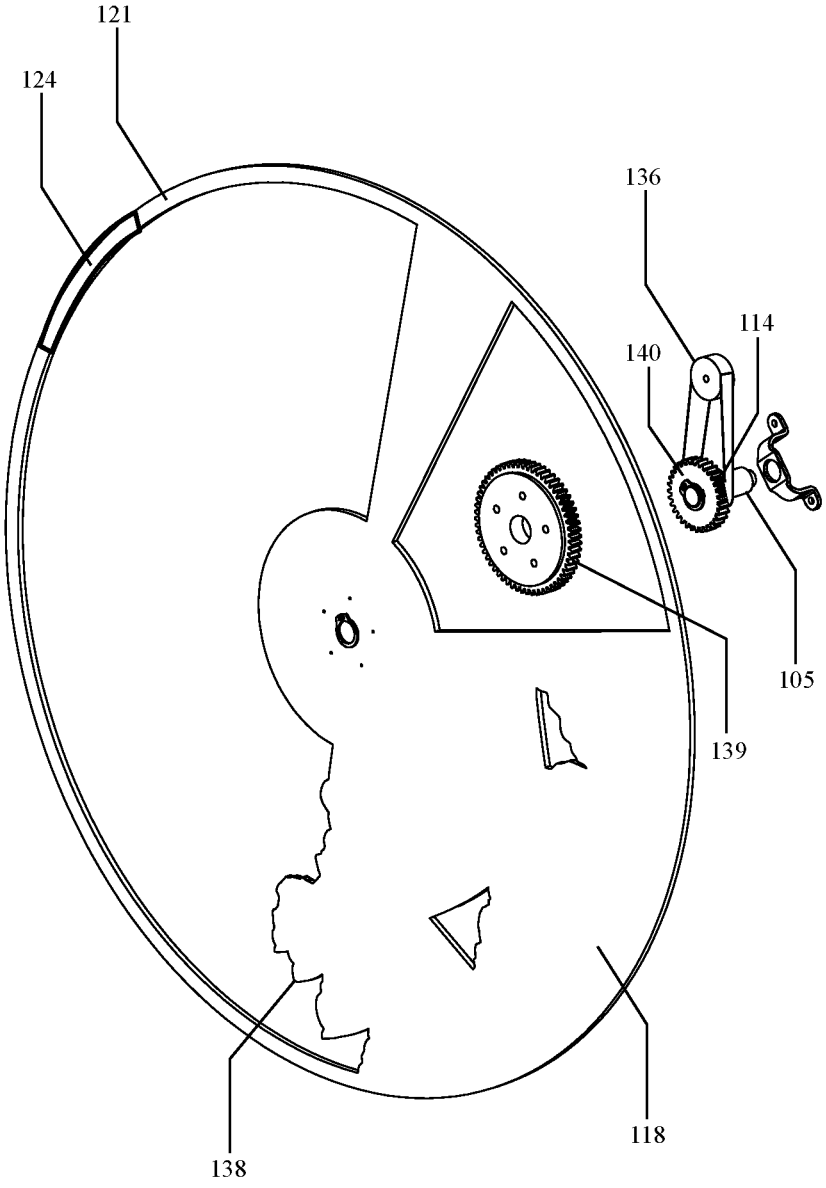
Figure 32:
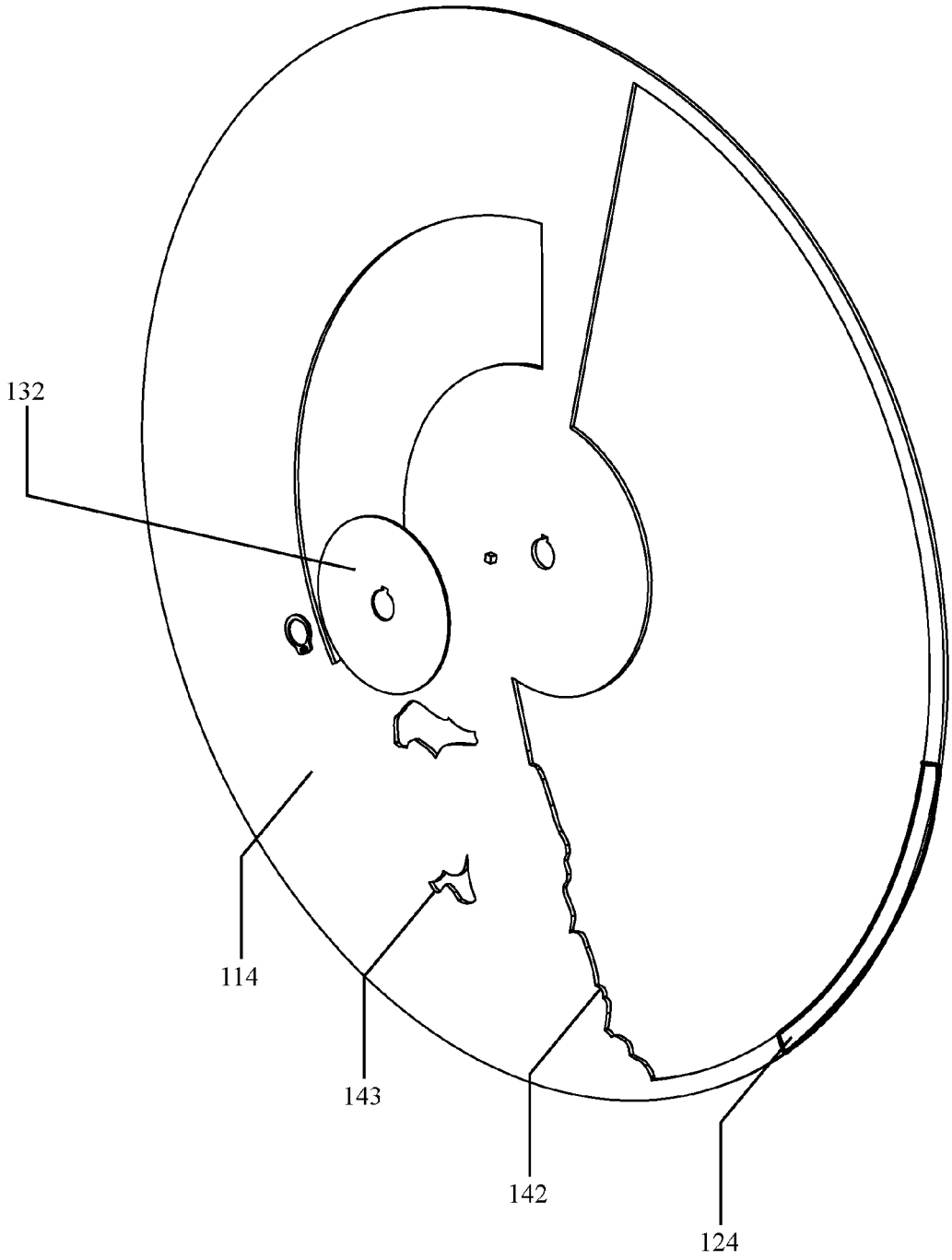

A further embodiment of the invention is further described in FIGS. 22 to 42, with means of example but not in any limitative sense with reference to the accompanying drawings of which:

FIG. 22 is a perspective view of a barometer clock in accordance with this invention;

FIGS. 23 to 27 show different stages of the display;

FIG. 28 is an exploded view of the display mechanism;

FIG. 29 shows the background assembly;

FIG. 30 shows the clouds display assembly;

FIG. 31 shows the rain display assembly;

FIG. 32 shows the storm display assembly; and

FIGS. 33 to 42 illustrate stages of movement of the mechanism in use.

Figure 1:
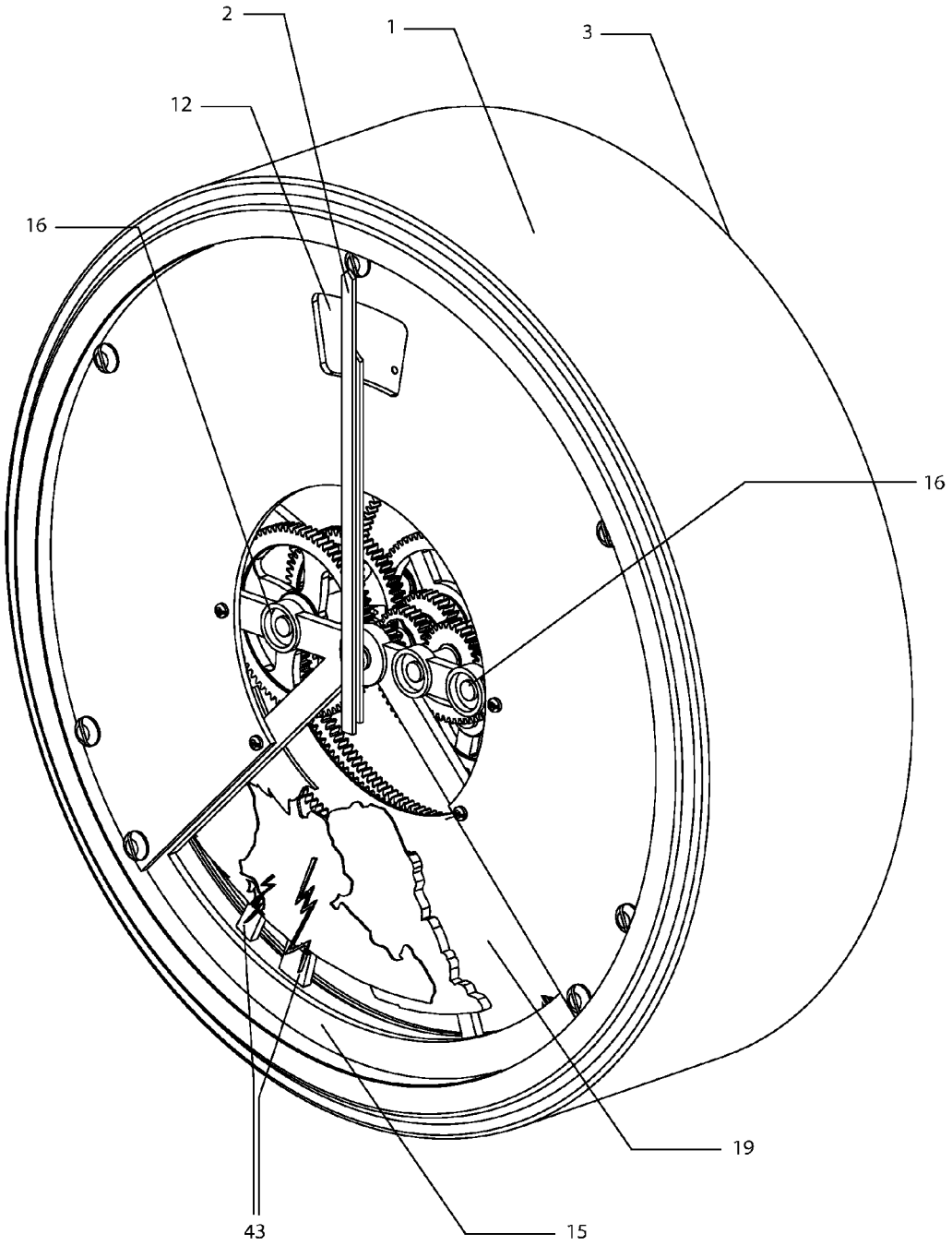
FIG. 1 is a perspective view of a barometer clock in accordance with this invention.
Figure 7:
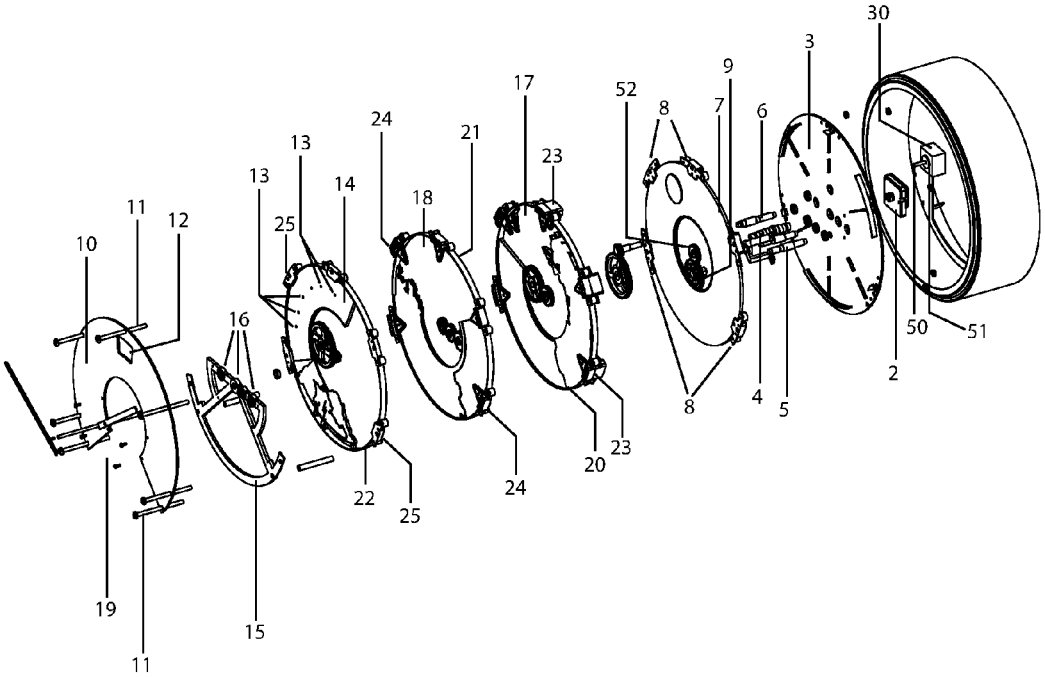
FIG. 7 is an exploded view of the display mechanism.
Figure 8:
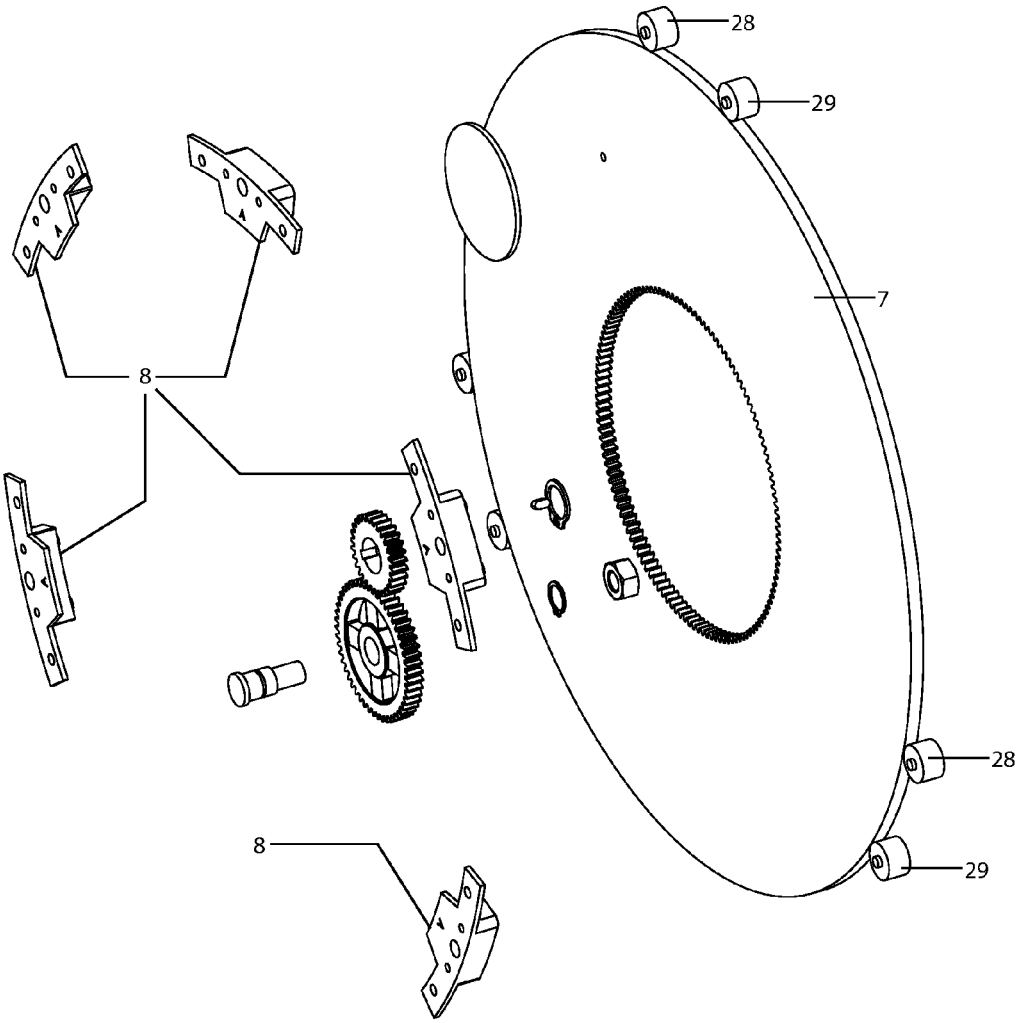
FIG. 8 shows the background assembly.

The barometer clock shown in FIGS. 1 and 7 comprises a casing (1), a clock mechanism (2). A back cover (3) as mountings for a central shaft (4) and right and left shafts (5, 6). An annular background member (7) is mounted in roller bearing (8) and is arranged to be rotatably driven by planetary gear system as described below. A motor gear subassembly (9) is connected to a stepper motor (30) to cause the background member (7) to rotate in use. The stepper motor (30) drives drive shaft (50) and drive gear (51) which in turn drives gear (52) mounted on an axial drive shaft (4). This gear arrangement increases the torque defined by the motor to the drive shaft (4).

The clock face comprises an annular plate (10) secured to the casing by bolts (11). A 90° quadrant at the lower part of the plate (10) is cut away to form an aperture segment (19) through which the background member (7) and any suitably located portions of the overlying members may be displayed.

The clock face also includes an arcuate opening (12) in an upper part of the face, to display successive words of, for example storm, dry, very dry, fair written onto the underlying "storm" display member (14) as the latter rotates in use as described below.

A generally quadrant-shaped frame (15) is mounted behind the opening (12) to provide a complete circumferential scale of hours and minutes for the clock face. The frame (15) also includes annular mounting (16) for the forward ends of the rotatable spindle and shafts (4, 5, 6).

Two part annular display members (17, 18) are coaxially mounted between the background display member (7) and the "storm" display member (14).

Each of the display members (14, 17, 18) has an annular configuration with a cut-away sector arranged to allow a user to see an underlying display through the aperture (19).

Each display member has a circular circumferential axially extending ring (20, 21, 22) upon which a multiplicity of roller bearings (23, 24, 25) are captive. In the illustrated embodiment five roller bearings are mounted on each ring. An alternative number of roller bearings, for example three or four may be employed as convenient.

Each roller bearing has forward and rear plates (26, 27) between which a pair of circumferentially spaced rollers (28, 29) are rotatably mounted on axial rods. The use of pairs of rollers allows the annular members to be coaxially located during assembly of the clock.

In a preferred embodiment the bearings share front and rear plates, so that the front plate of one member serves as the rear plate in the adjacent overlying member. In this way the display members are constrained to rotate in parallel spaced relation. Each of the display members (17, 18, 19) has an image on the front surface and a leading edge which is configured to give a silhouette of a weather feature.

Figure 9:
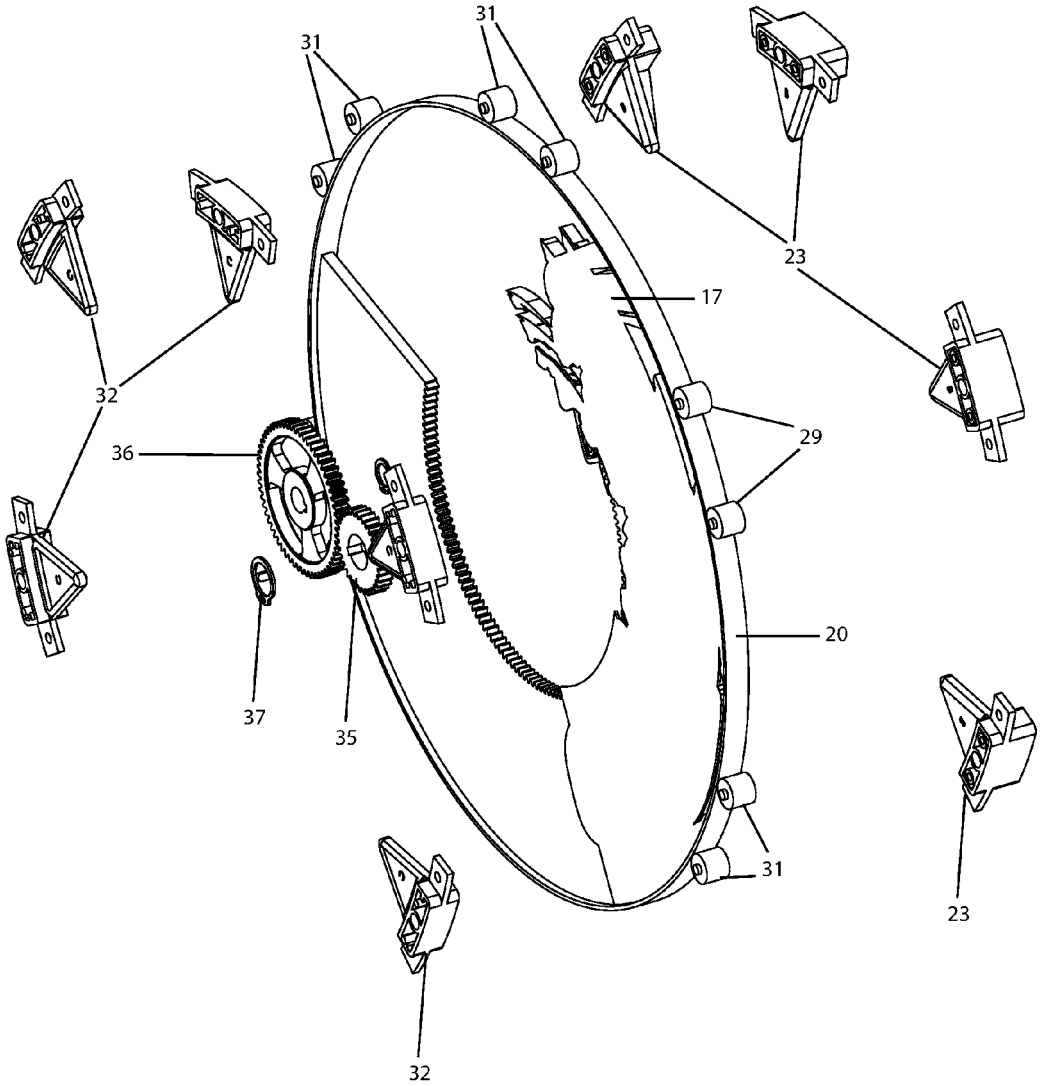
FIG. 9 shows the clouds display assembly.

FIG. 9 shows the "clouds" display member comprising an annular display (17) mounted in a cylindrical ring (20) supported by pairs of rollers (31) mounted in housing (23, 32).

Figure 3:
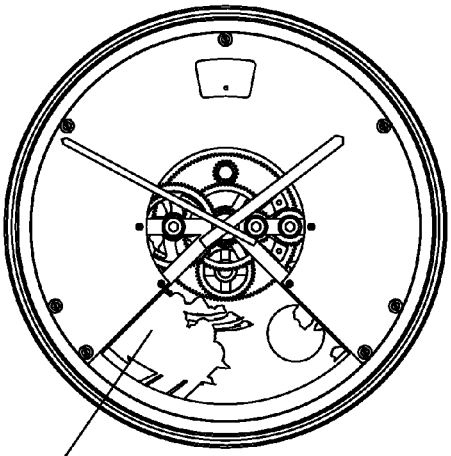

The leading edge (34) of the "clouds" display is configured to represent clouds as shown in FIG. 3.

The drive mechanism for the "clouds" display member comprises a planetary gear arrangement to be retained by one or more clips (37). An axial sun gear (35) having 16 teeth, engages a planetary gear (36) having 76 teeth, the annulus forming an orbital gear having 168 teeth. Rotation of the sun gear (35) at 26.32 rpm causes rotation of the planetary gear (36) at 5.54 rpm and the orbital gear and hence the display is caused to rotate at 2.51 rpm.

Figure 5:
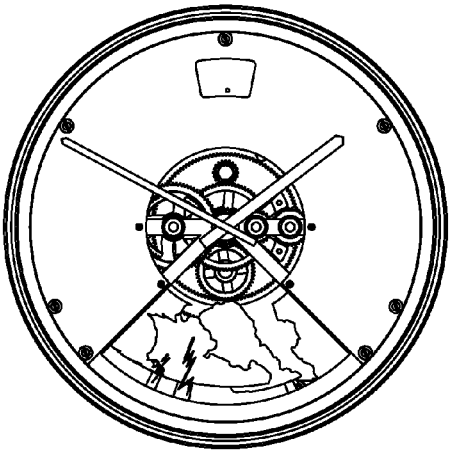
Figure 10:
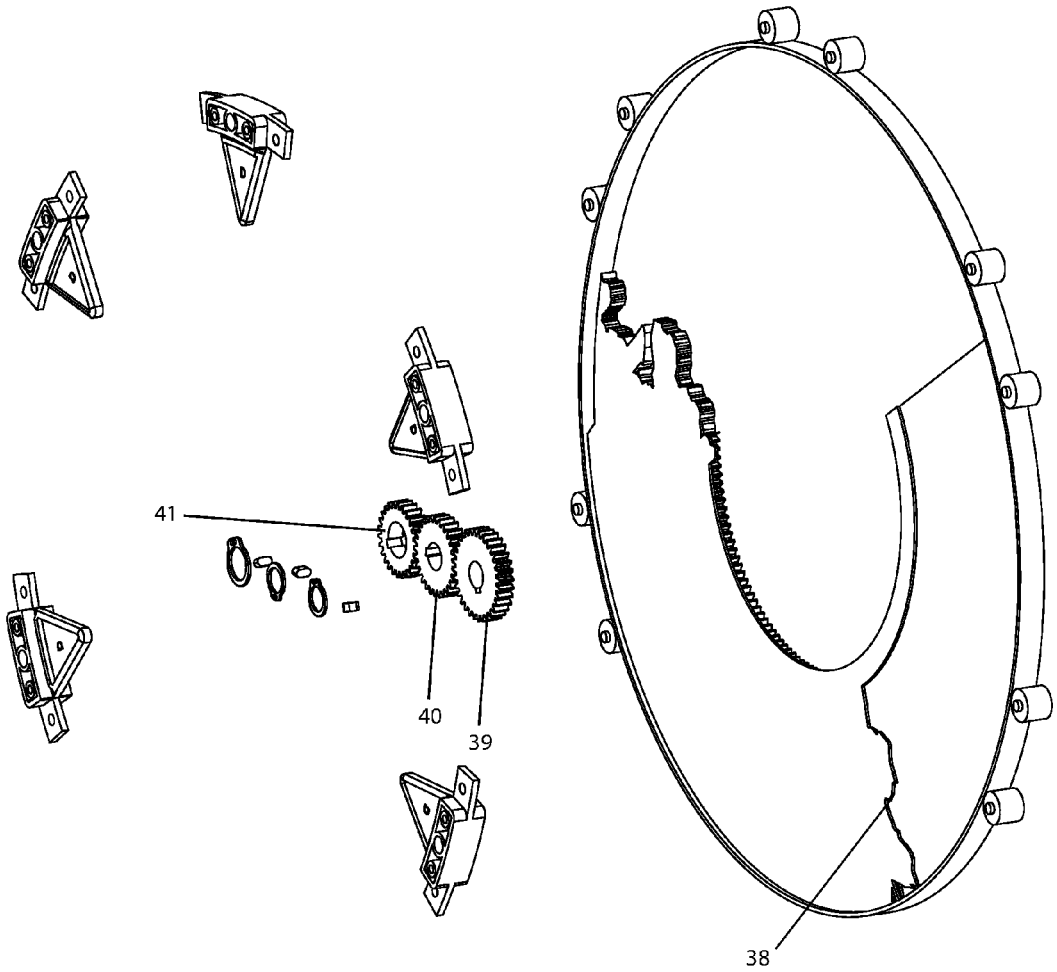
FIG. 10 shows the rain display assembly.
Figure 11:
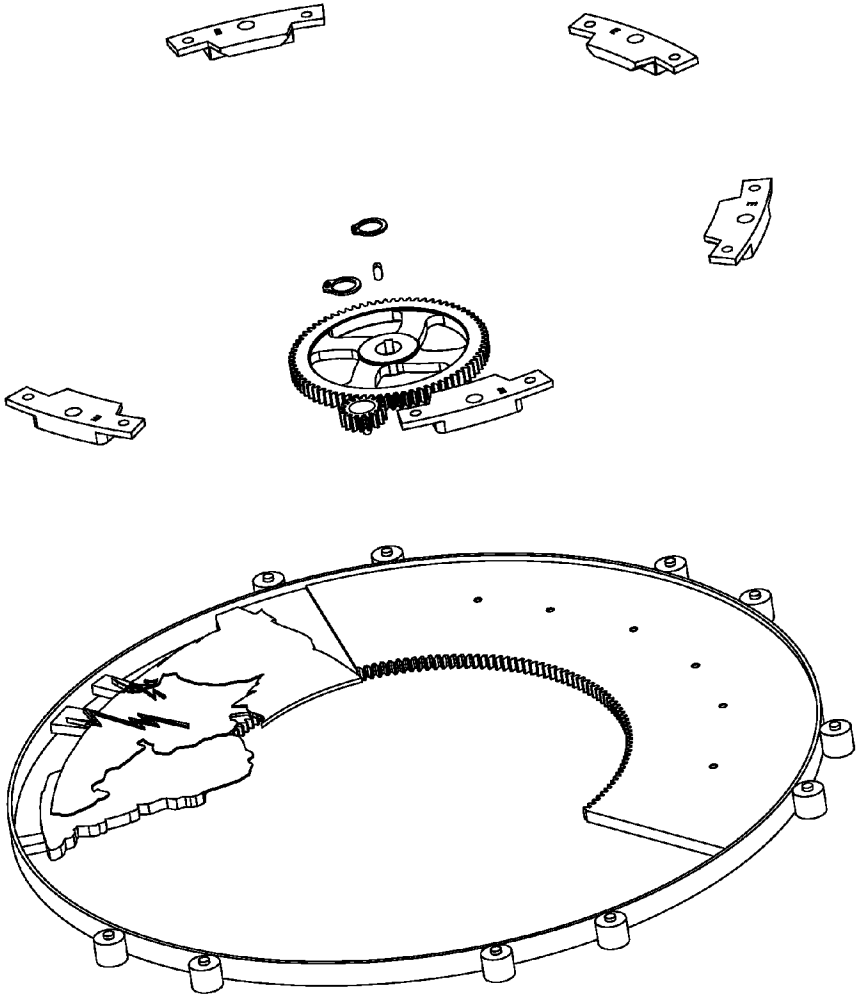
FIG. 11 shows the storm display assembly.

The leading edge (38) of the "rain" display, shown in FIGS. 5 and 10, is configured to represent rain clouds. An axial sun gear (39) having 26 teeth is connected via a chain comprising an inner planetary gear (40) having 28 teeth and an outer planetary gear (41) having 32 teeth to the annular orbital gear having 152 teeth. Rotation of the sun gear (39) at 26.32 rpm causes the first planetary gear (40) to rotate at 24.44 rpm at the outer planetary gear (41) to rotate at 21.39 rpm, driving the orbital gear to rotate at 4.69 rpm. The direction of rotation is opposite to that of the "cloud" display described above.

The "storm" display, located forwardly of the "rain" display has an annular display plate (14) provided with fixing holes (13) for location of signs to display the words "storm", "fair", "very dry", "change", "rain" or other wording as appropriate for display through the aperture (12) in the upper part of the clock face.

The leading edge (42) has the silhouette of a storm cloud, behind which, in the direction of rotation, are representations (43) of lightning bolts.

The drive mechanism for the "storm" display comprises a planetary gear arrangement having a sun gear (44) with 16 teeth and a planetary gear (45) with 76 teeth engaging the annular orbital gear (47) with 168 teeth. Rotation of the sun gear at 26.32 rpm causes the planetary gear (45) to rotate at 5.54 rpm causing the orbital gear and display to rotate at 2.51 rpm. The direction of rotation is the same as for the cloud display and opposite to the direction of rotation of the rain display.

Figure 2:
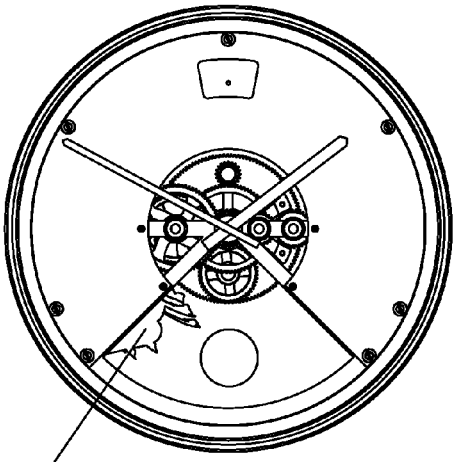
FIGS. 2 to 6 show different stages of the display.
Figure 12:
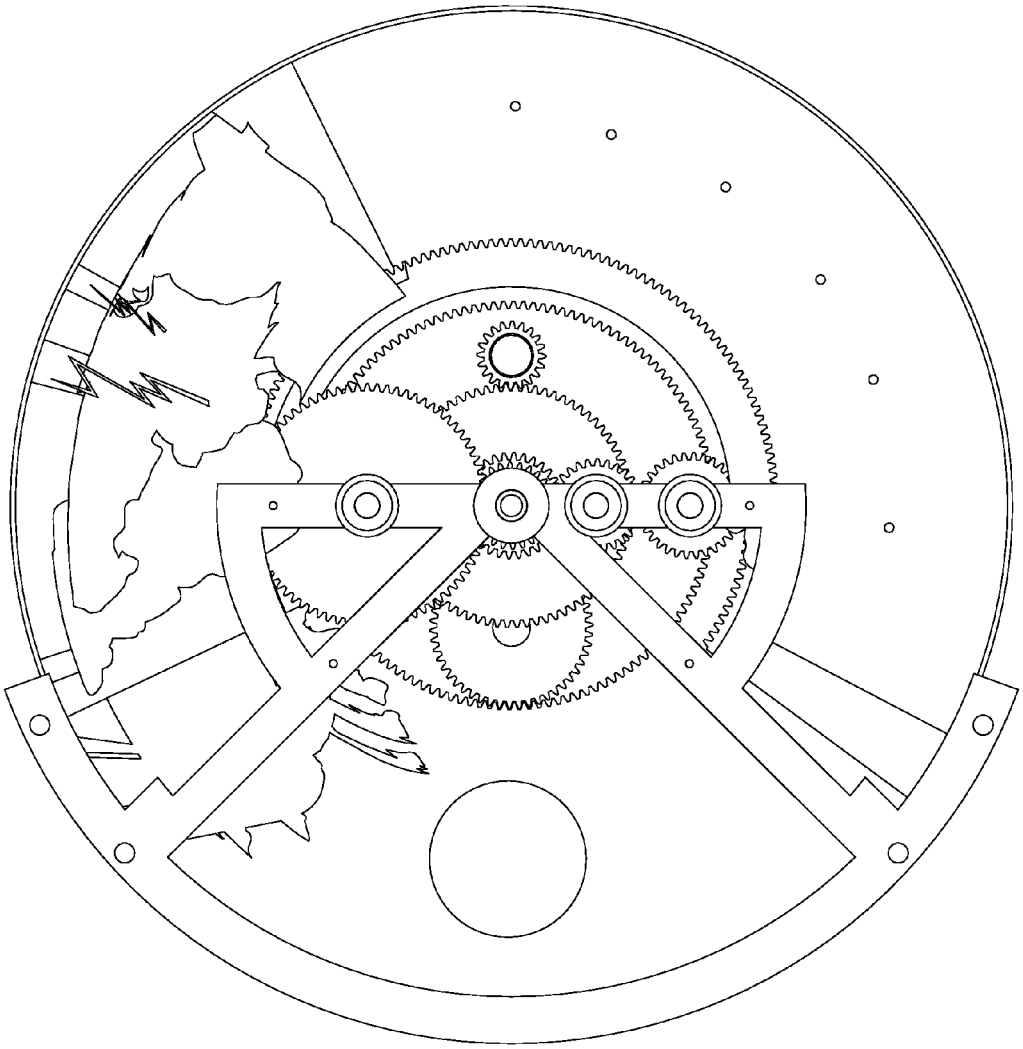
FIGS. 12 to 21 illustrate stages of movement of the mechanism in use.
Figure 13:
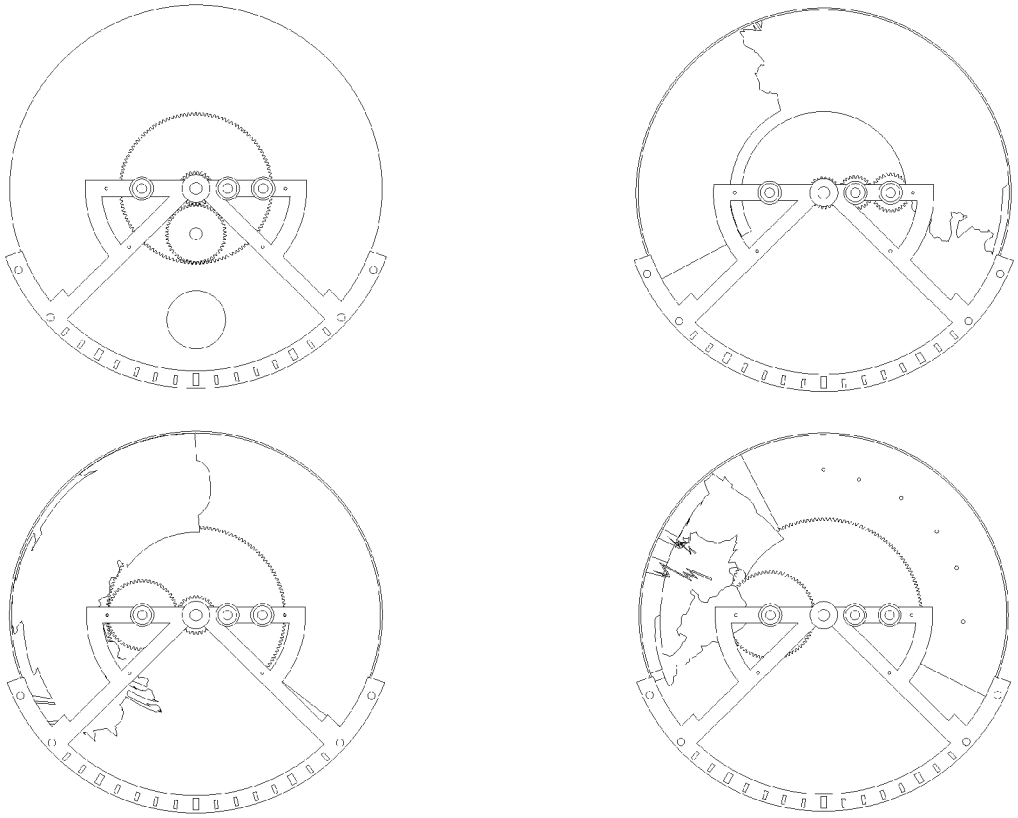

FIGS. 12 and 13 illustrate the rest position of the barometer display mechanism. In this position the cloud and storm displays are fully retracted in the clockwise direction and the cloud display is fully retracted in the anti-clockwise direction to provide a display as shown in FIG. 2. The positions of the various components are shown in FIG. 13. This arrangement is indicative of "very dry" weather conditions.

Figure 14:
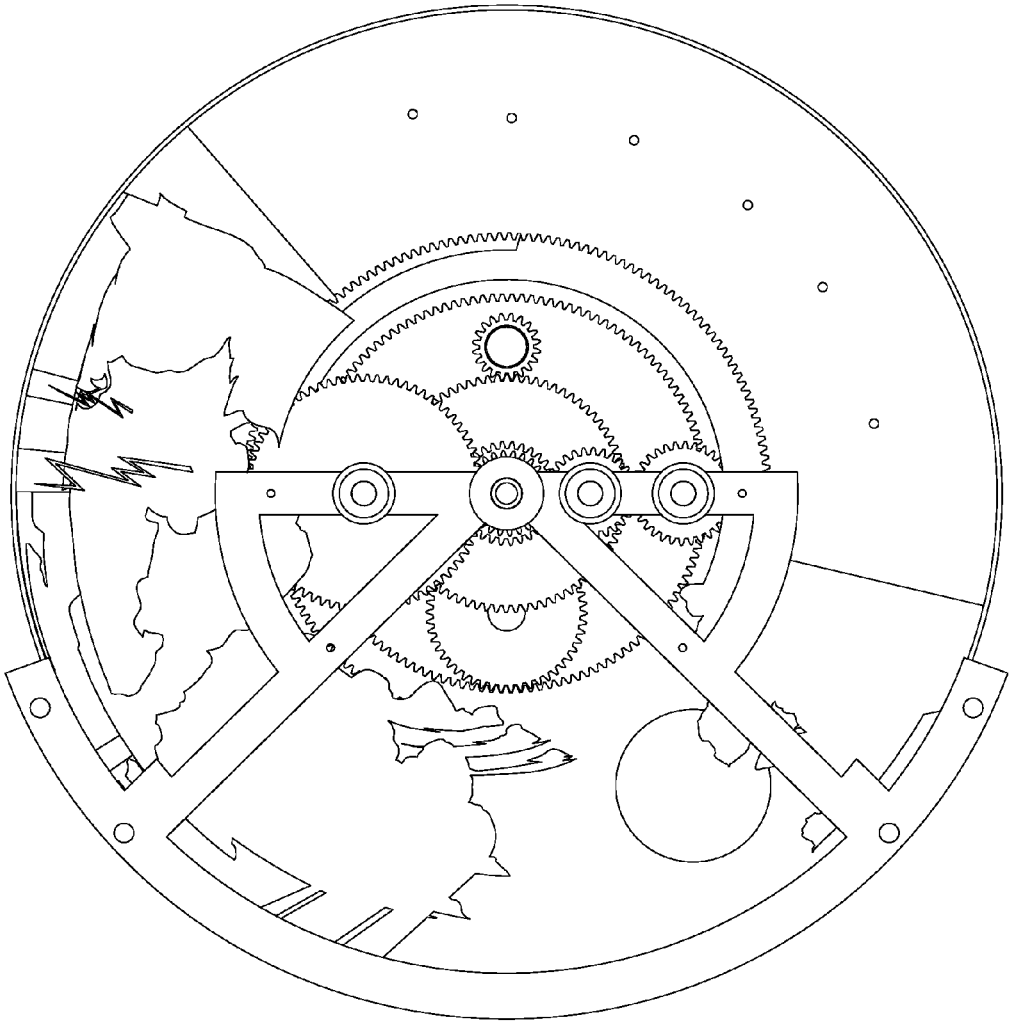
Figure 15:
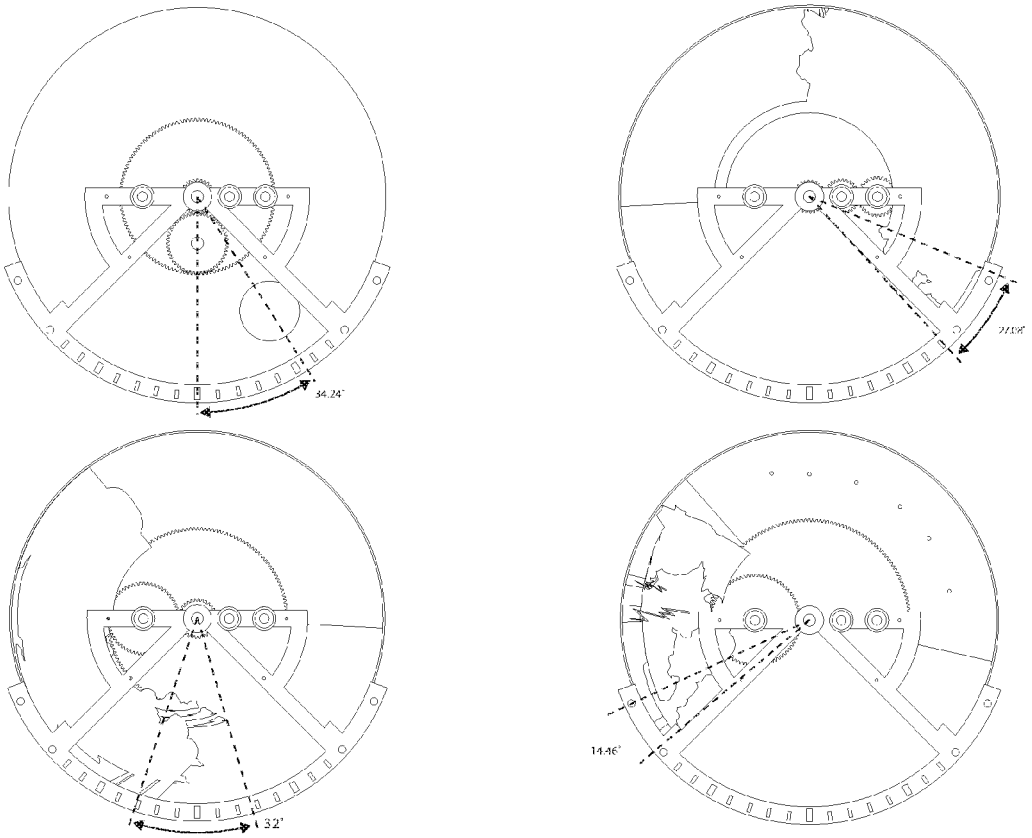

In FIGS. 14 and 15 the first stage of rotation of the displays is shown, following a first incremental rotation of the sun gears by the stepper motor in response to a signal from the barometric sensor. As shown in FIG. 3 the "clouds" display (18) is rotated anti-clockwise so that it is partially visible within the aperture quadrant at the lower part of the clock face. The configuration of the various components is shown in FIG. 15.

In FIG. 15 at the first stage of rotation the background (7) related to an angle of 34° 24". The "clouds" display (18) is rotated clockwise at an angle of 27° 0.8". The "rain" display (17) is rotated anticlockwise by an angle of 32° and the "storm" display (14) is rotated anticlockwise by an angle of 14° 46".

Figure 4:
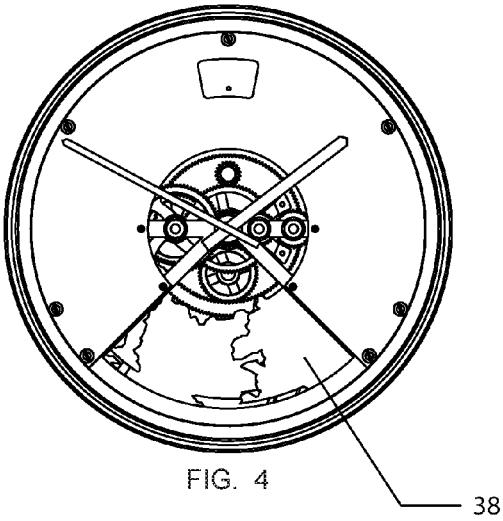
Figure 16:
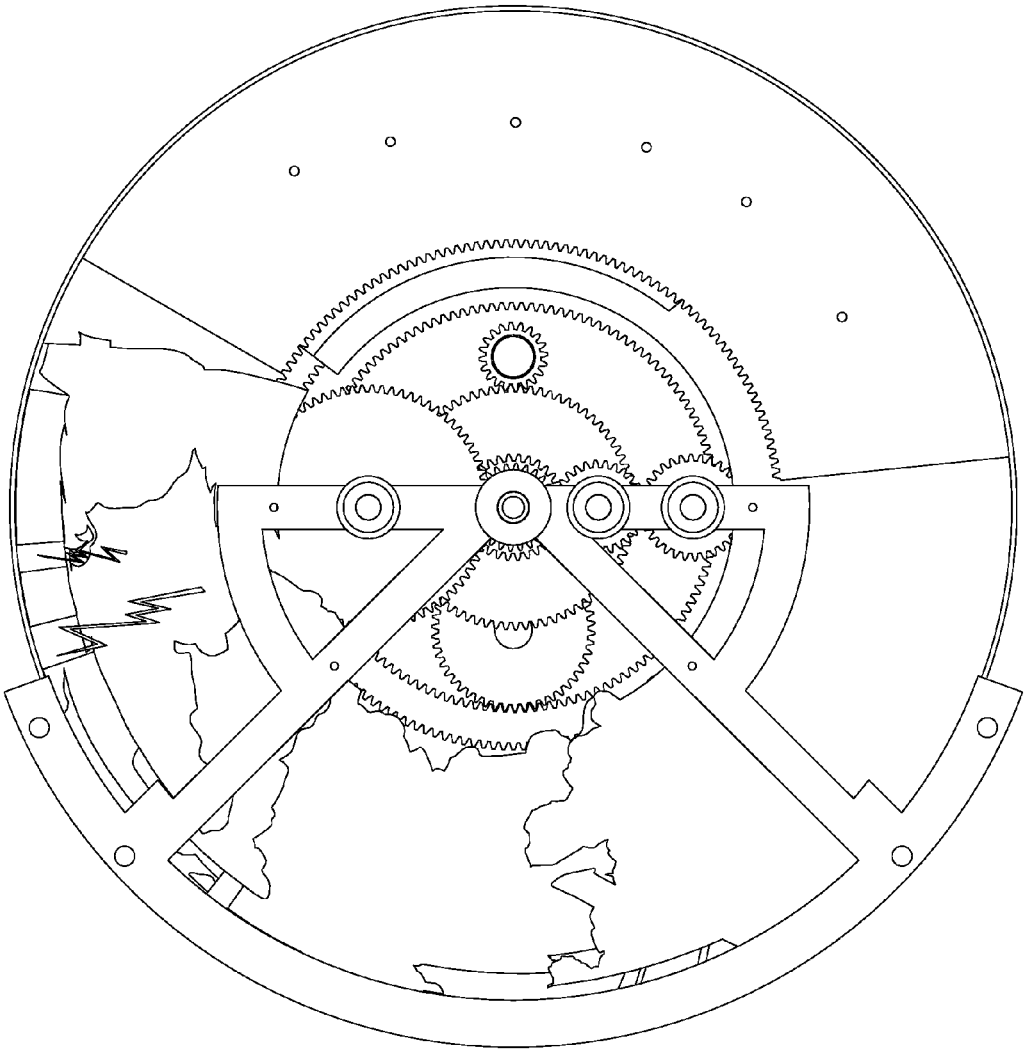
Figure 17:
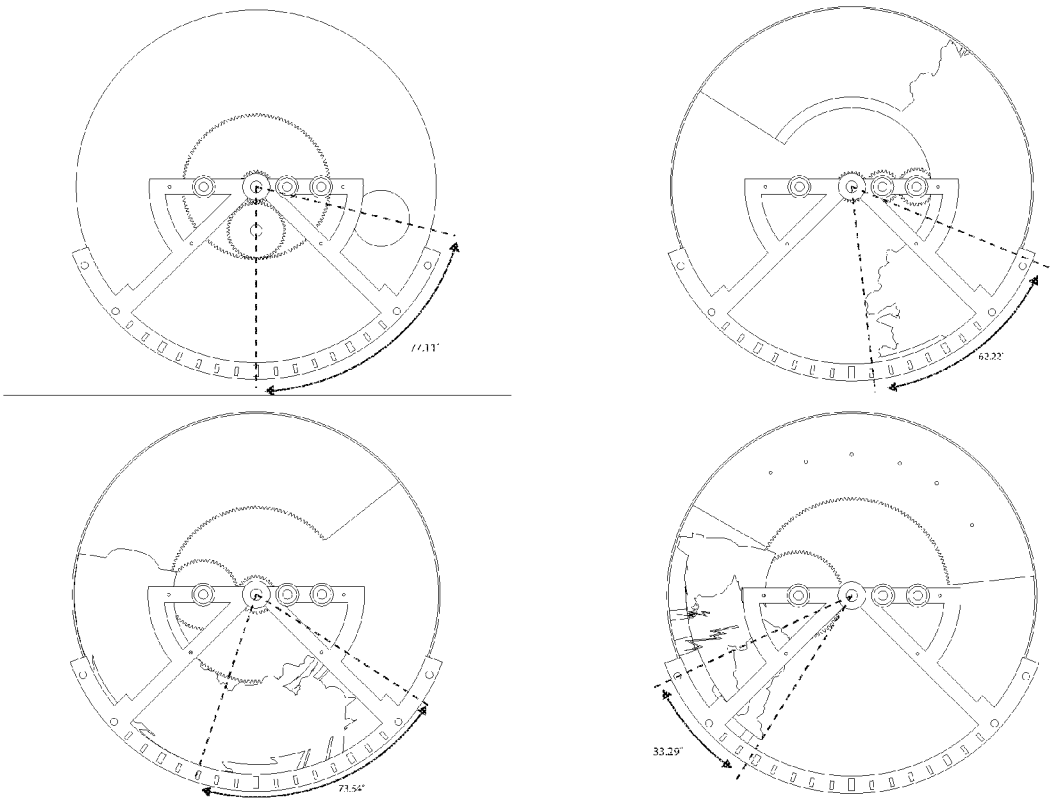

FIGS. 16 and 17 show a second position wherein the "clouds" display (18) is fully rotated clockwise and the "rain" display is rotated anti-clockwise to overly the "clouds" display as shown in FIG. 4. This is the changeable position and the word "change" is displayed in the upper aperture (12) on the clock face. This second stage is reached following 3.61 revolutions of the drive motor from rest.

In FIGS. 16 and 17 the background display (7) is rotated to an angle of 77° 11" in the anticlockwise direction. The "clouds" display (18) is rotated through 62° 22" in the clockwise direction, the "rain" display (17) is rotated through 73° 54" in the anticlockwise direction and the "storm" display (14) is rotated through 33° 29" in the anticlockwise direction.

Figure 18:
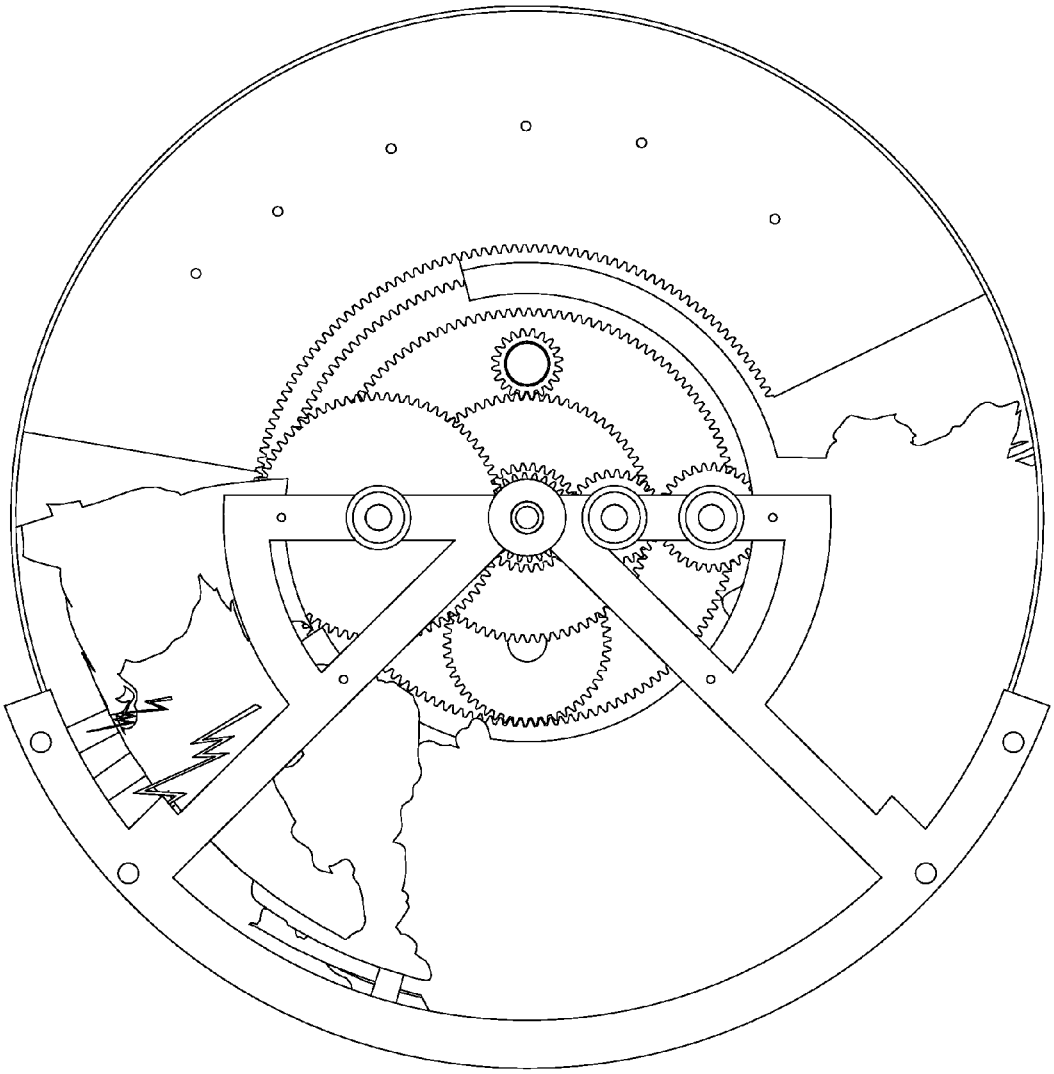
Figure 19:
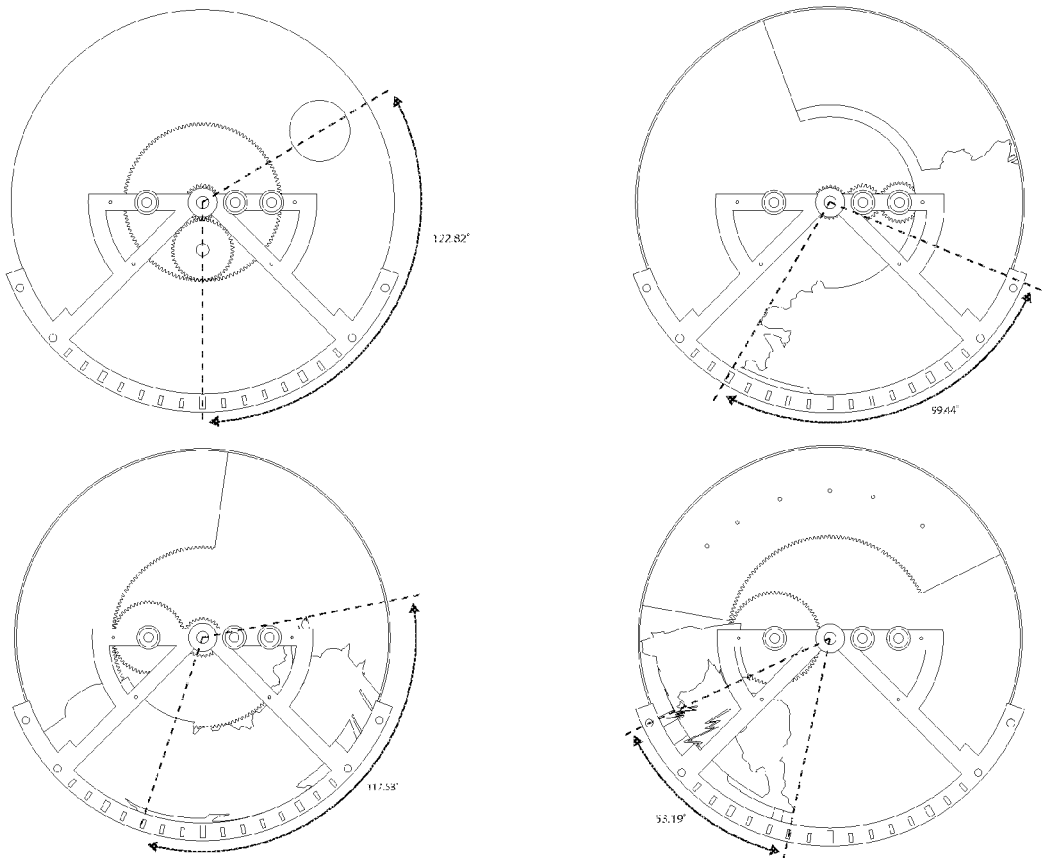

FIGS. 18 and 19 show a third position achieved through 5.89 revolutions of the drum rest. In this position the "rain" display is rotated clockwise through 117° and the "clouds" display is rotated anti-clockwise through 99°. The "storm" display is rotated anti-clockwise by 53° to provide the display as shown in FIG. 5 with the word "rain" displayed in the aperture (12).

In the third position shown in FIGS. 18 and 19 the background display is rotated anticlockwise through 122° 82", the "cloud" display is rotated clockwise through 99° 44", and the "clouds" display is rotated anticlockwise through 117° 53" and the "storm" display is rotated through 53° 19".

Figure 6:
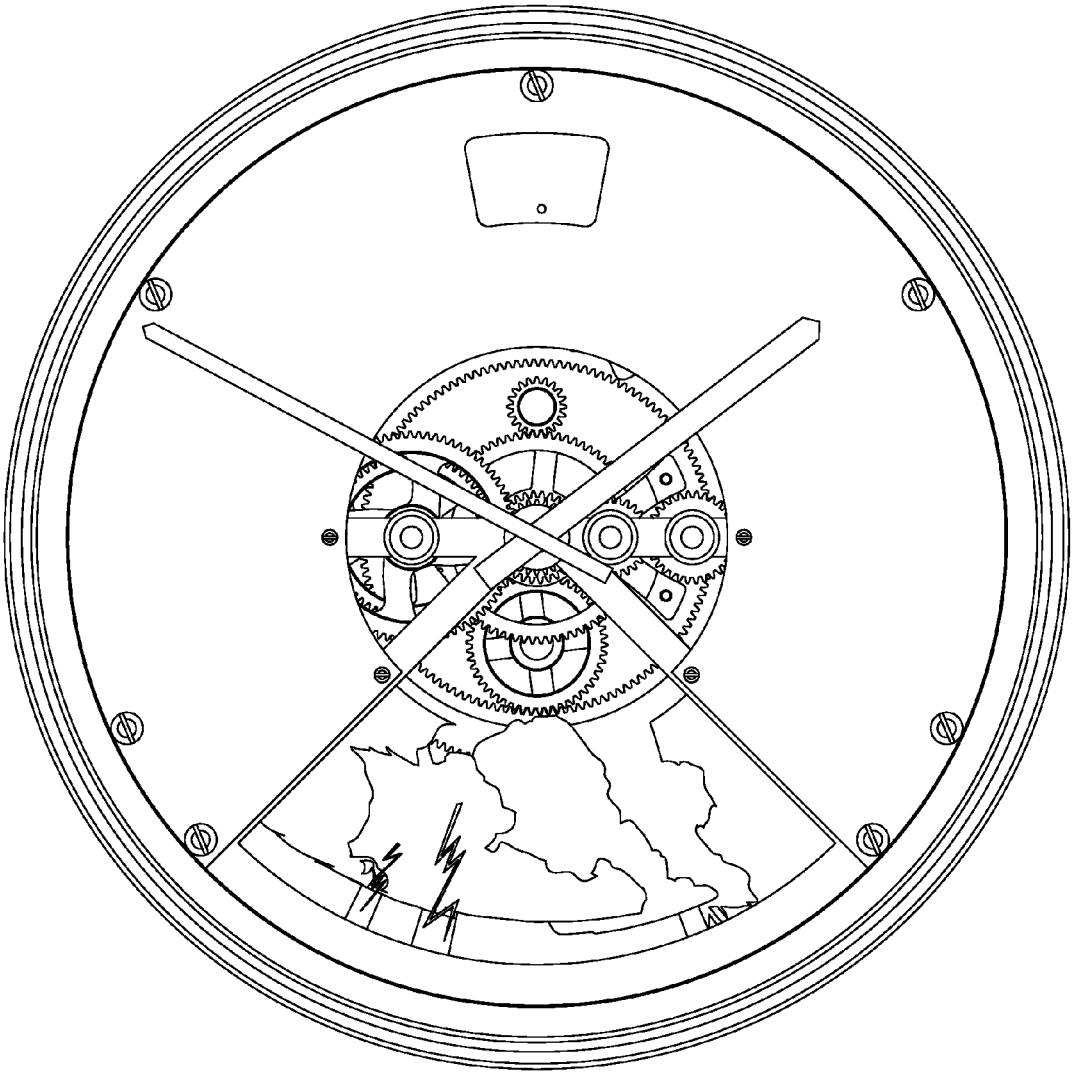
Figure 20:
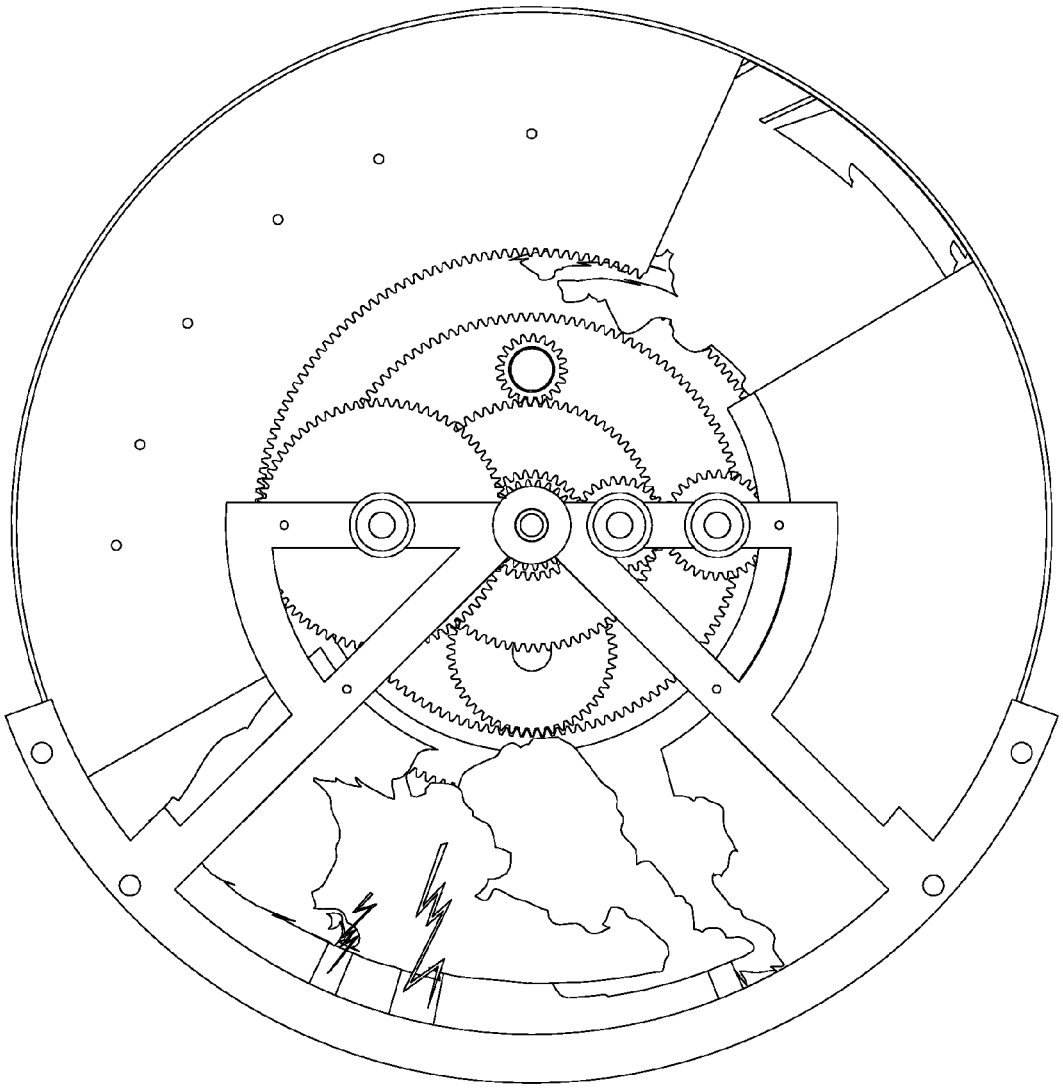
Figure 21:
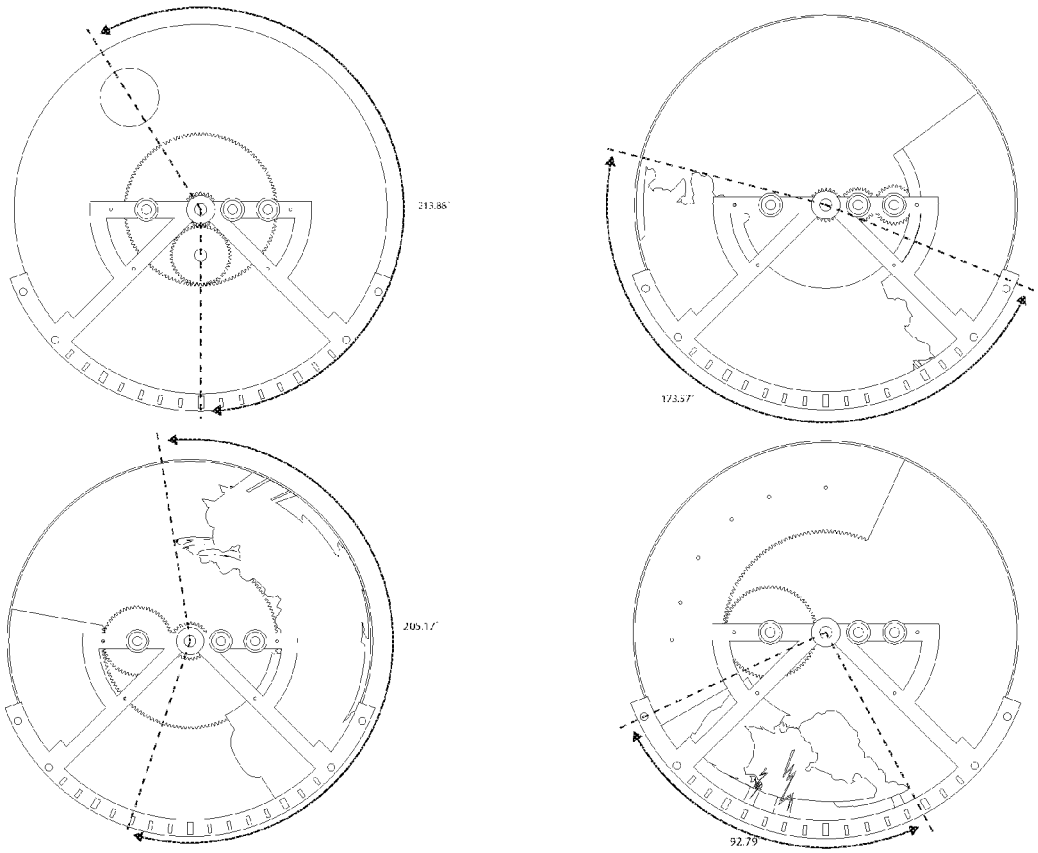

In a final "storm" position illustrated in FIGS. 20 and 21 achieved by rotation of the stepper motor through 3.61 revolutions from rest, the "rain" display is fully rotated through 205° anti-clockwise and the "clouds" display is fully rotated through 173° clockwise. The "storm" display is fully rotated through 92° clockwise to provide the display shown in FIG. 6.

The fourth and final position shown in FIGS. 20 and 21, the background display is rotated through 213° 88" in the anticlockwise direction, the "cloud" display is rotated through 173° 57" in the clockwise direction, the "rain" display rotated through 205° 17" in the anticlockwise direction and the "storm" display is rotated through 92° 79" in the anticlockwise direction.

FIGS. 22 to 42 show a further embodiment of the invention.

The barometer clock shown in FIGS. 22 and 28-31 comprises a casing (101), a clock mechanism (102). A housing (103) as mountings for a central shaft (104), left shaft (105) and drive shaft (106). An annular background member (107) is mounted in housing (103) and is arranged to be visible through aperture (119) in face plate (110). A motor gear sub-assembly (109) is connected to a stepper motor (130) to cause the display members (114, 117, 118) to rotate in use. The stepper motor (130) drives drive shaft (106) and drive pulley (151) which in turn drives pulley (152) mounted on an axial central shaft (104). This pulley arrangement increases the torque defined by the motor to the drive shaft (106).

The clock face comprises an annular plate (110) secured to housing (103). A 90° quadrant at the lower part of the plate (110) is cut away to form an aperture segment (119) through which the background member (107) and any suitably located portions of the overlying members may be displayed.

The clock face also includes an arcuate opening (112) in an upper part of the face, to display successive words of, for example storm, dry, very dry, fair written onto the underlying "storm" display member (114) as the latter rotates in use as described below.

The clock face (110) also includes annular mounting (116) for the forward ends of the central shafts (114).

Two part annular display members (117, 118) are coaxially mounted between the background display member (107) and the "storm" display member (114).

Each of the display members (114, 117, 118) has an annular configuration with a cut-away sector arranged to allow a user to see an underlying display through the aperture (119).

Each display member has a circular circumferential axially extending ring (120,121,122) upon which a multiplicity balancing weights (123, 124) are captive and employed to offset the weight of display members axially. In the illustrated embodiment one weight is mounted on each ring. An alternative number of weights, for example three or four may be employed as convenient.

Each of the display members (114,117,118) has an image on the front surface and a leading edge which is configured to give a silhouette of a weather feature.

FIG. 30 shows the "clouds" display member comprising an annular display (117) mounted in a cylindrical ring (120) supported by position plate (131) mounted on central shaft (104).

Figure 24:
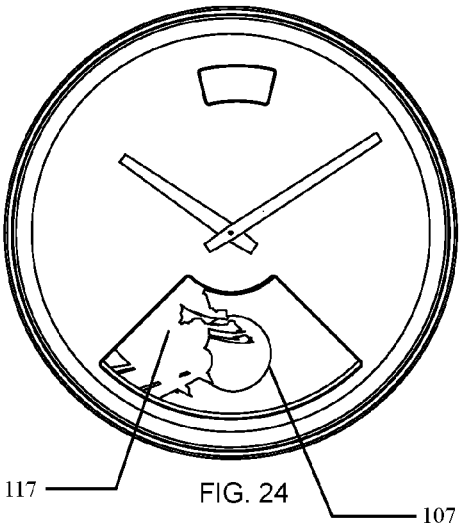

The leading edge (134) of the "clouds" display is configured to represent clouds as shown in FIG. 24.

The drive mechanism for the "clouds" display member, shown in FIGS. 29 and 30, comprises a planetary gear/pulley arrangement to be retained by one or more clips (137). An axial sun pulley (152) having 72 teeth and mounted on central shaft (104), engages a planetary pulley (151) having 20 teeth mounted on drive shaft (106). Rotation of planetary pulley (151) on drive shaft (106) by stepper motor (130), causes rotation of sun pulley (152) and consequently the rotation of drive shaft (104) and the display member.

The leading edge (138) of the "rain" display, shown in FIGS. 24 and 31, is configured to represent rain clouds and is mounted on an axial sun gear (139). Sun gear (139) having 60 teeth is connected to the drive shaft via a chain comprising a planetary gear (140) having 32 teeth and planetary pulley (141) having 20 mounted on shaft (105) and pulley (136). Rotation of pulley (136) on drive shaft (106) rotates shaft (105) and planetary gear (140) by planetary pulley (141). Rotation of gear (140) drives rotation of sun gear (139) and the display member. The direction of rotation is opposite to that of the "cloud" display described above.

The "storm" display, shown in FIG. 32, located forwardly of the "rain" display has an annular display plate (114) provided with locations to display the words "storm", "fair", "very dry", "change", "rain" or other wording as appropriate for display through the aperture (112) in the upper part of the clock face. The display member is mounted on central shaft (104) by support plate (132).

The leading edge (142) has the silhouette of a storm cloud, behind which, in the direction of rotation, are representations (143) of lightning bolts.

The "storm" display utilises the same drive mechanism as the cloud display member and is rotated by rotation of central shaft as described above (104). The direction of rotation is the same as for the cloud display and opposite to the direction of rotation of the rain display.

Figure 23:
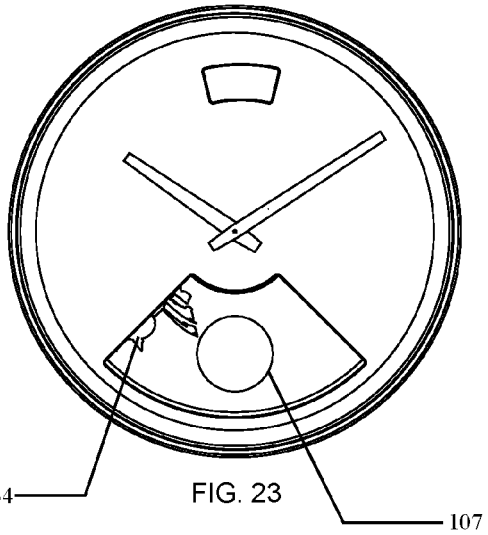
Figure 33:
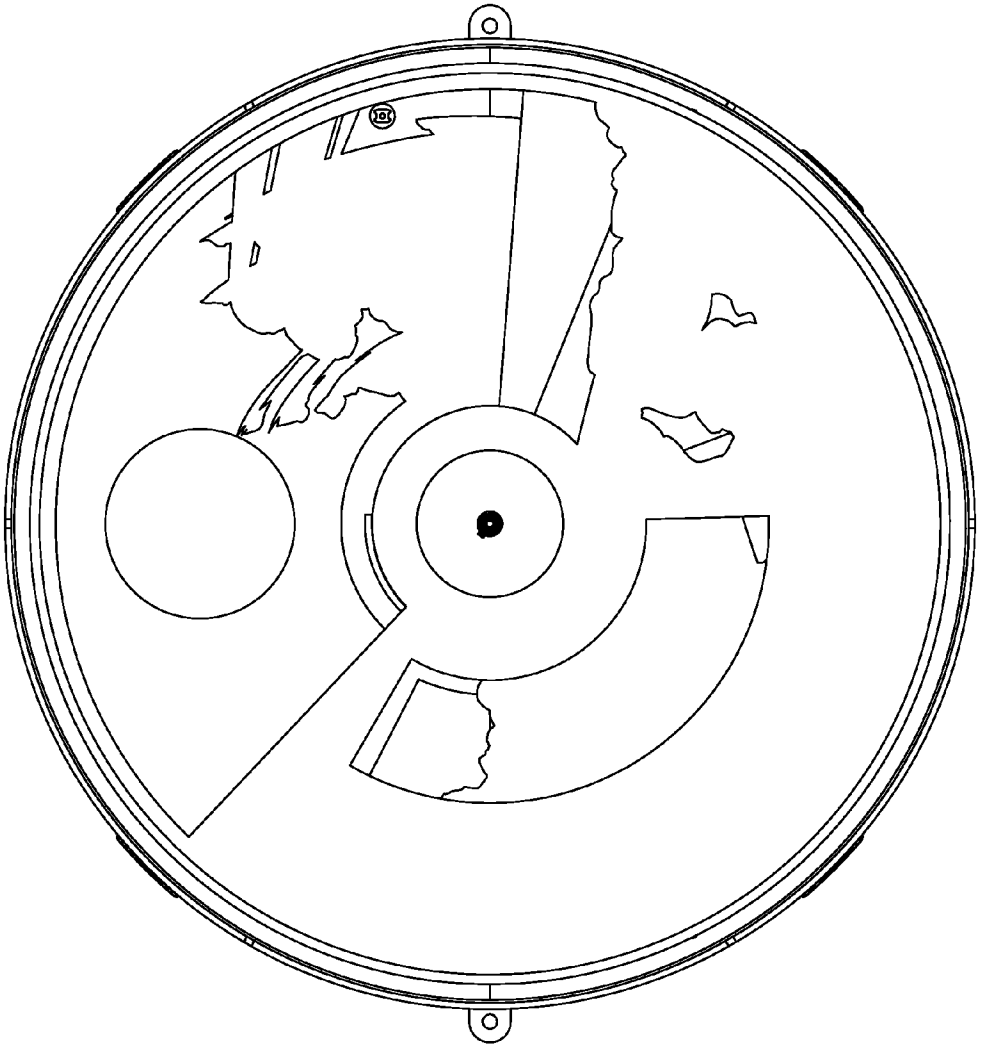
Figure 34:
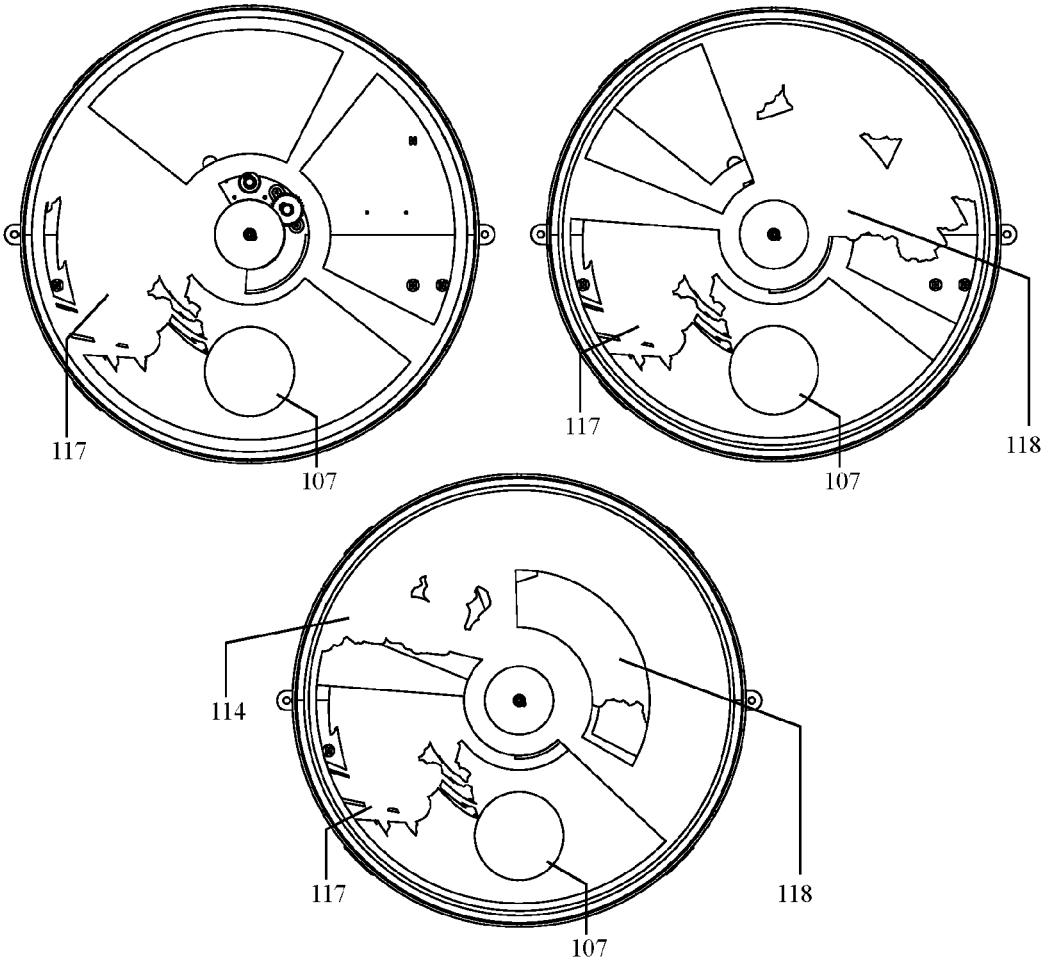

FIGS. 33 and 34 illustrate the rest position of the barometer display mechanism. In this position the cloud and storm displays are fully retracted in the clockwise direction and the rain display is fully retracted in the anti-clockwise direction to provide a display as shown in FIG. 23. The positions of the various components are shown in FIG. 34. This arrangement is indicative of "very dry" weather conditions.

Figure 35:
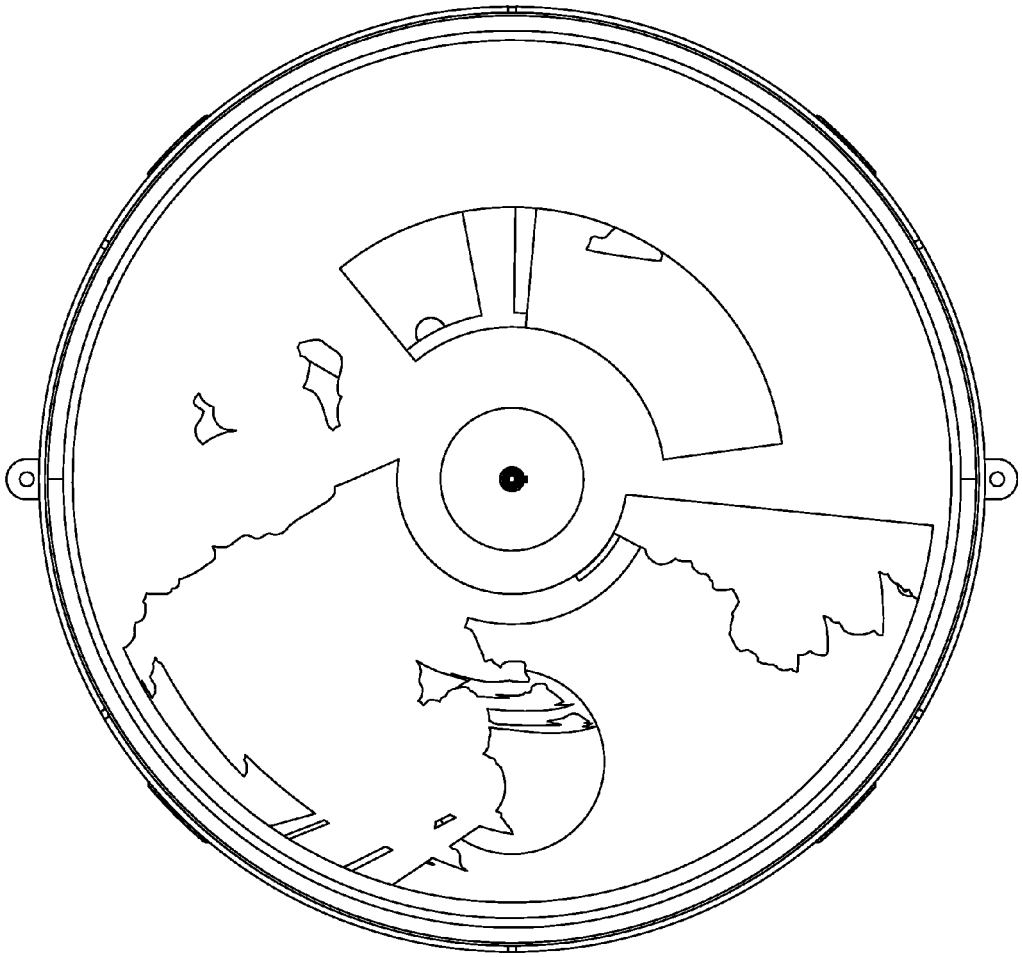
Figure 36:
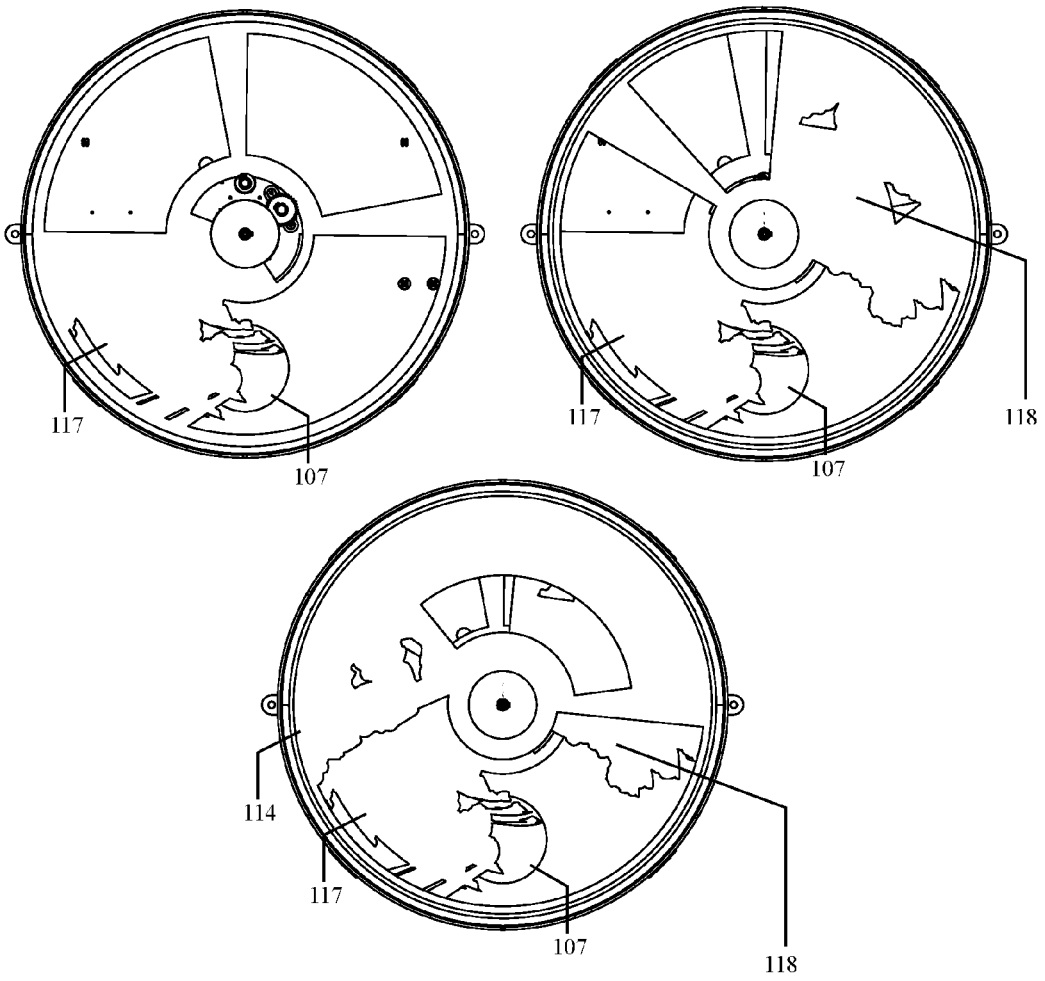

In FIGS. 35 and 36 the first stage of rotation of the displays is shown, following a first incremental rotation of the sun gears and pulleys by the stepper motor in response to a signal from the barometric sensor. As shown in FIG. 24 the "clouds" display (118) is rotated anti-clockwise so that it is partially visible within the aperture quadrant at the lower part of the clock face. The configuration of the various components is shown in FIG. 36.

In FIG. 36 at the first stage of rotation the "clouds" display (118) is rotated clockwise at an angle of 27° 0.8". The "rain" display (117) is rotated anticlockwise by an angle of 32° and the "storm" display (114) is rotated anticlockwise by an angle of 14° 46".

Figure 25:
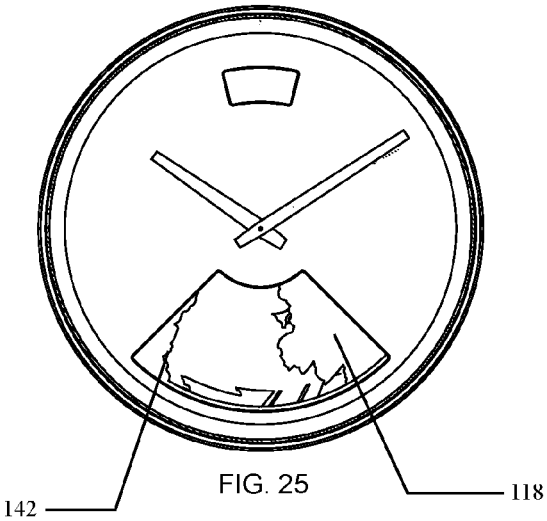
Figure 37:
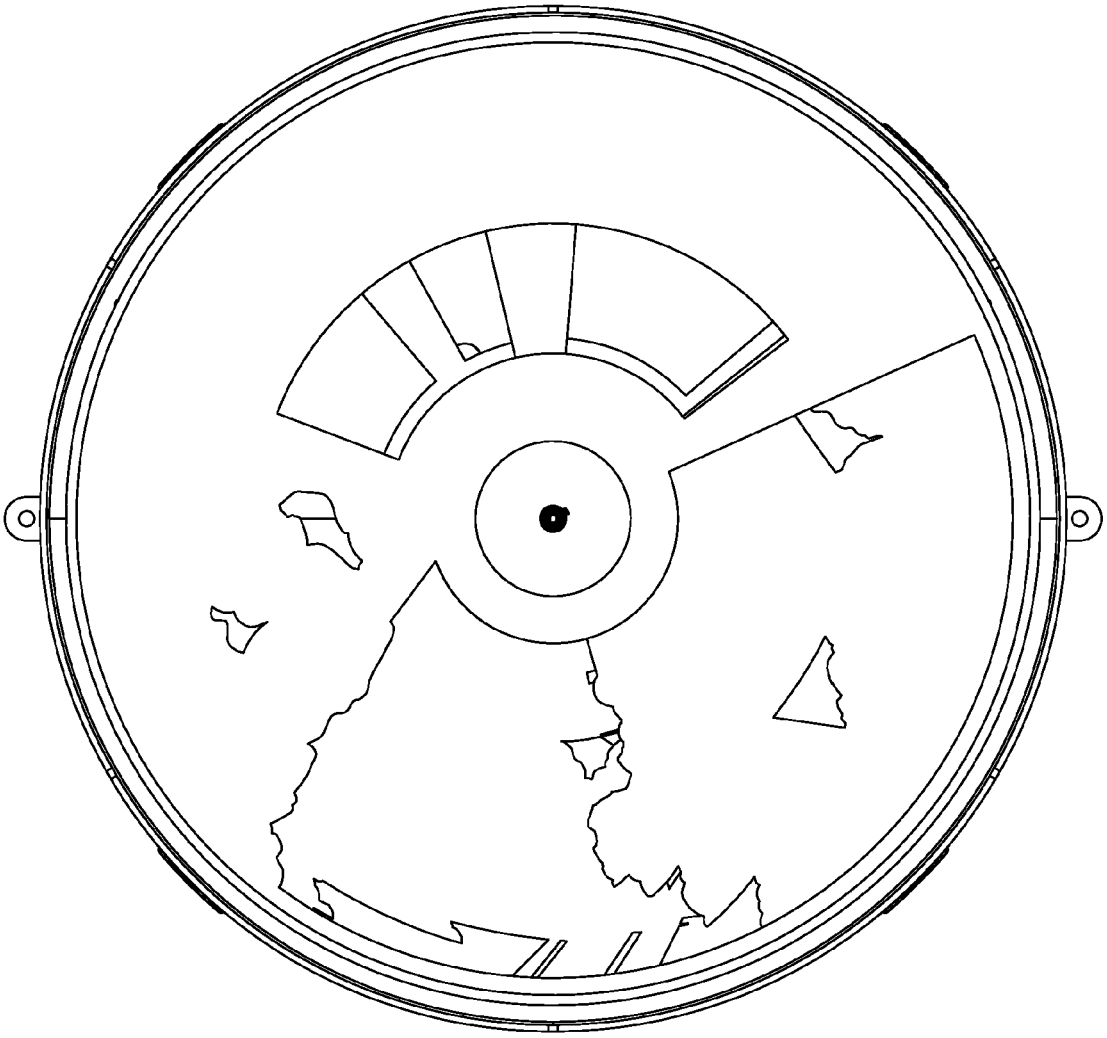
Figure 38:
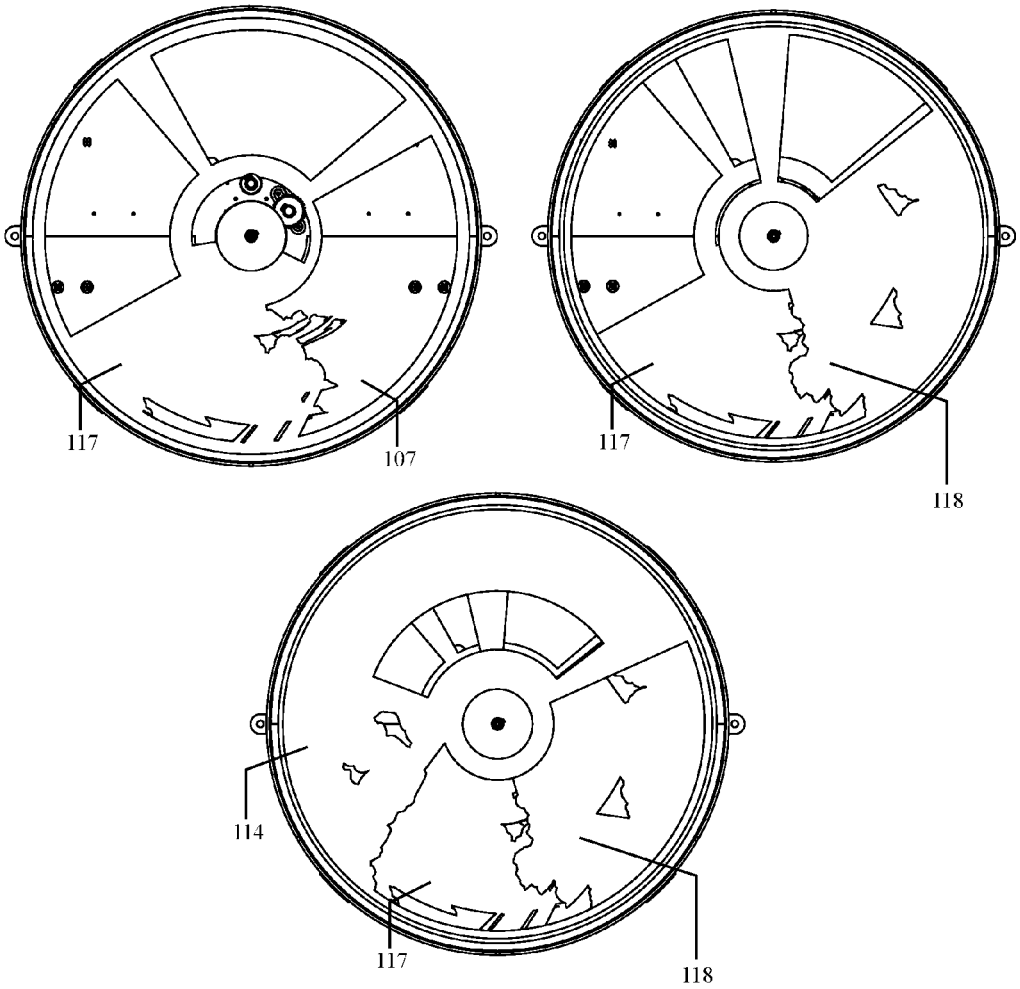

FIGS. 37 and 38 show a second position wherein the "clouds" display (118) is fully rotated clockwise and the "rain" display is rotated anti-clockwise to overly the "clouds" display as shown in FIG. 25. This is the changeable position and the word "change" is displayed in the upper aperture (112) on the clock face.

In FIGS. 37 and 38 the "clouds" display (118) is rotated through 62° 22" in the clockwise direction, the "rain" display (117) is rotated through 73° 54" in the anticlockwise direction and the "storm" display (114) is rotated through 33° 29" in the anticlockwise direction.

Figure 26:
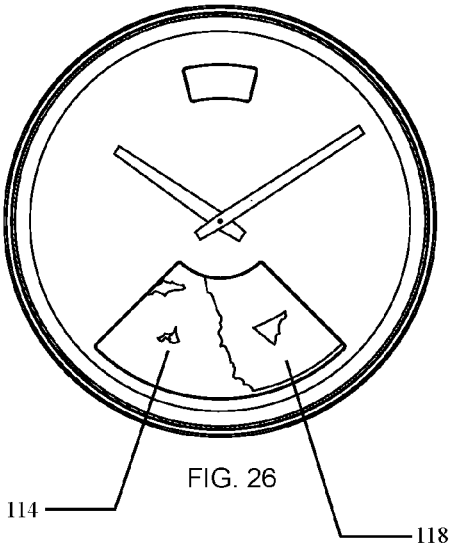
Figure 27:
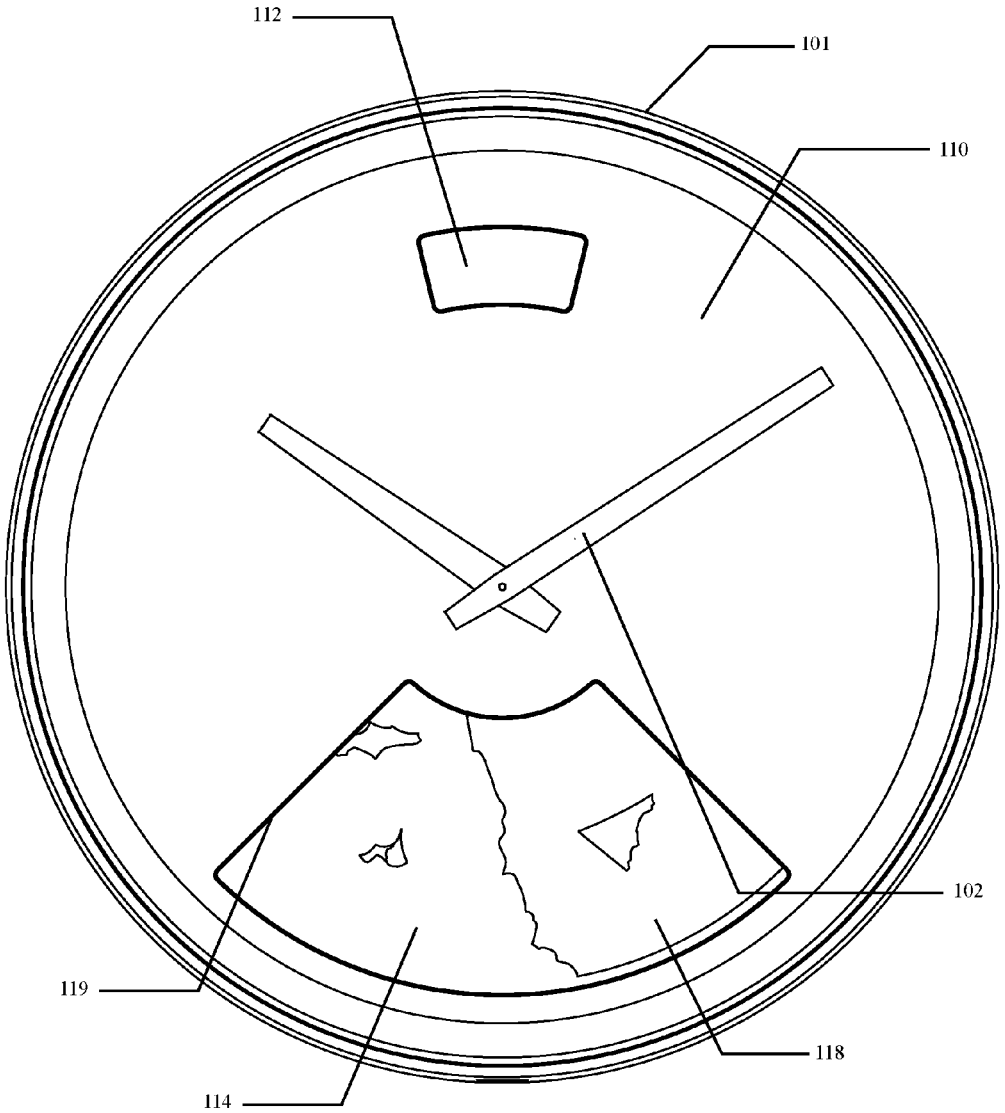
Figure 39:
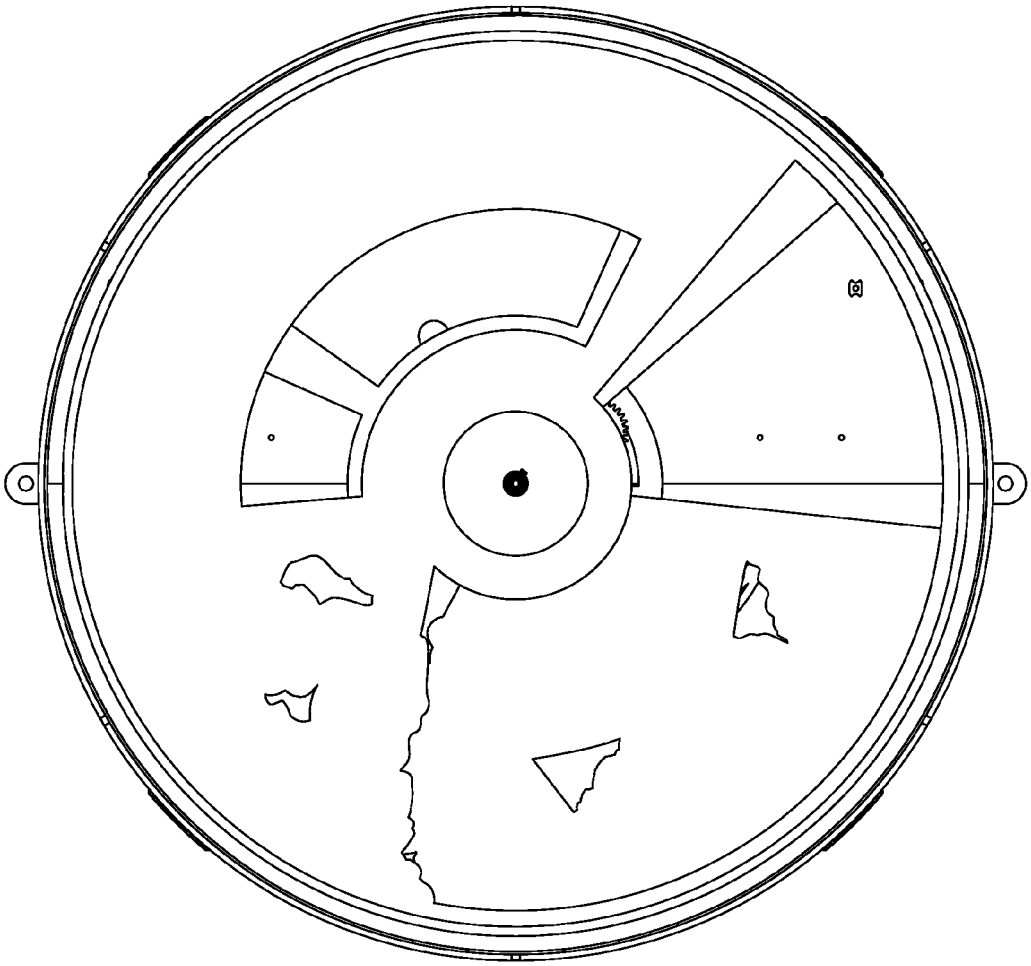
Figure 40:
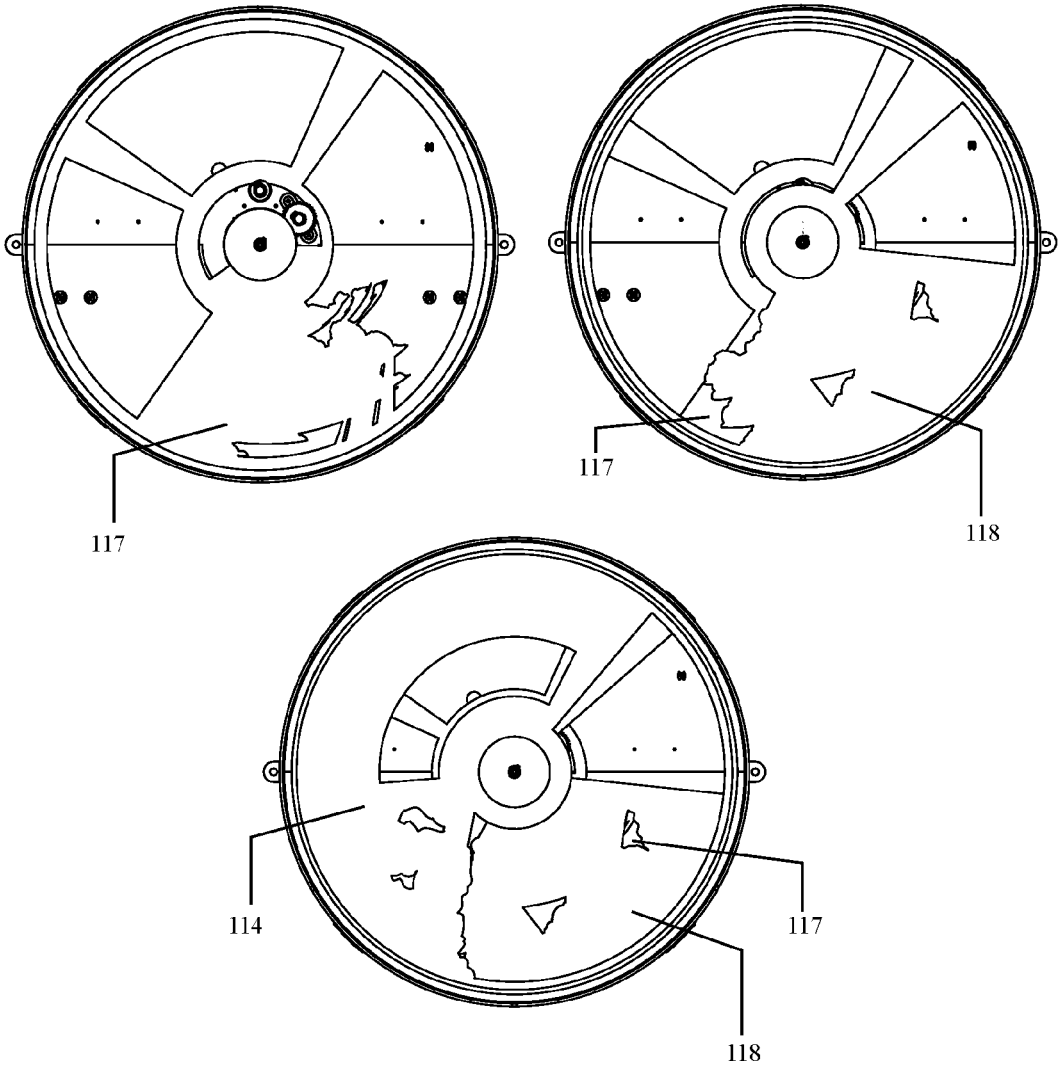

FIGS. 39 and 40 show a third position. In this position the "rain" display (117) is rotated clockwise through 117° and the "clouds" display (118) is rotated anti-clockwise through 99°. The "storm" display (114) is rotated anti-clockwise by 53° to provide the display as shown in FIG. 26 with the word "rain" displayed in the aperture (112).

Figure 41:
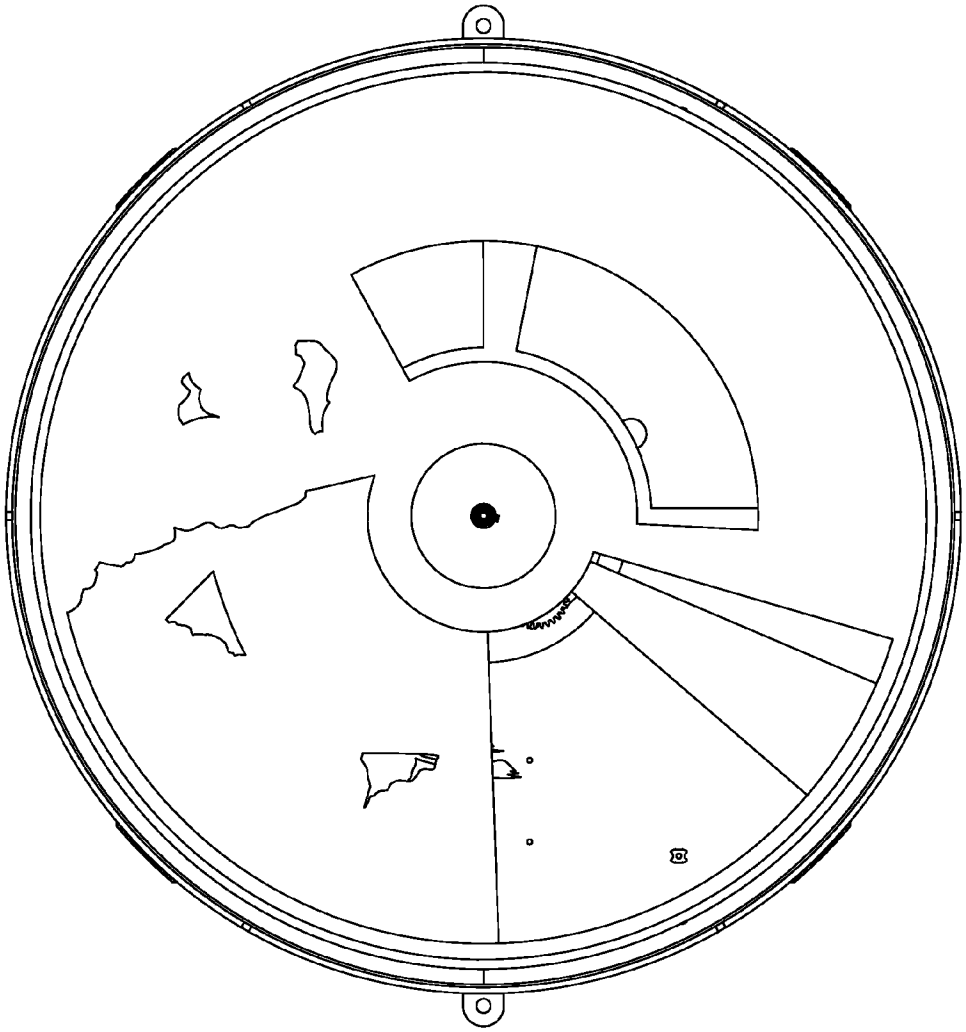
Figure 42:
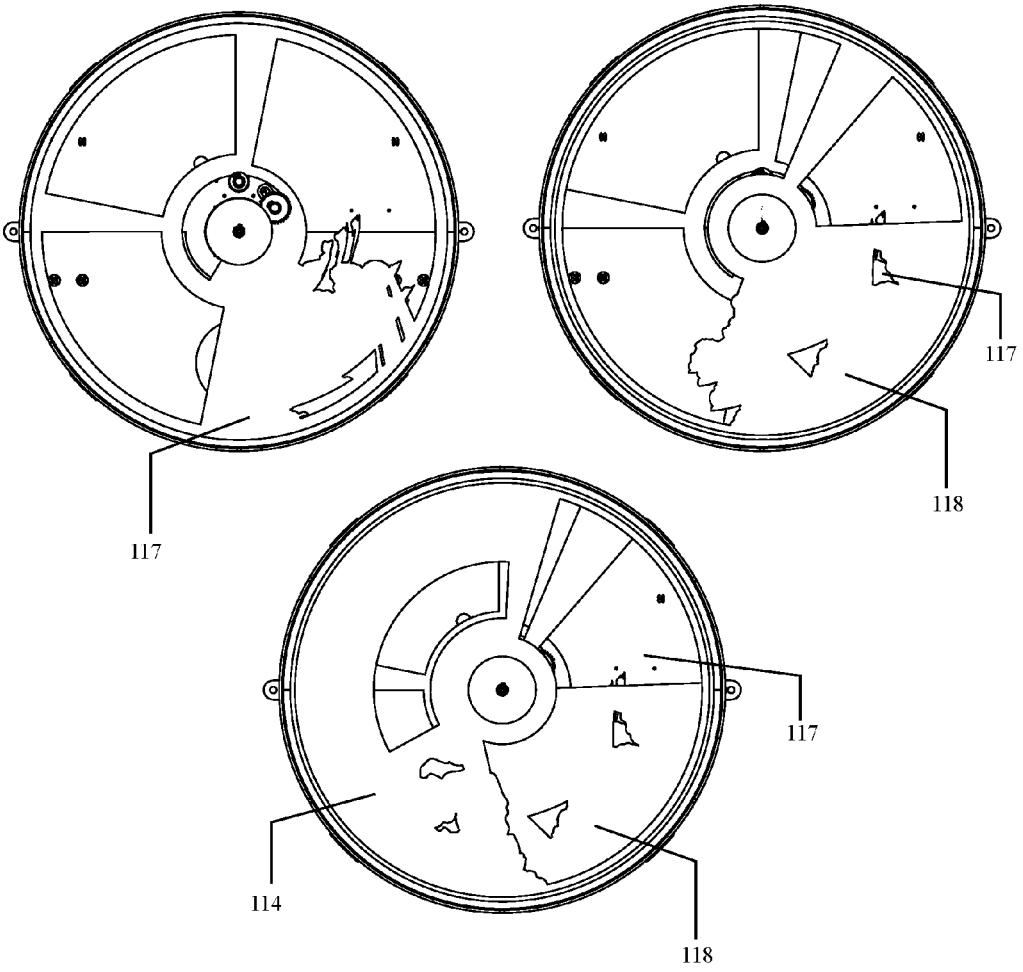

The fourth and final position shown in FIGS. 41 and 42, the "cloud" display (118) is rotated through 173° 57" in the clockwise direction, the "rain" display (117) rotated through 205° 17" in the anticlockwise direction and the "storm" display (114) is rotated through 92° 79" in the anticlockwise direction. Stormy is displayed in the aperture (112).

The invention claimed is:

1. A barometer clock comprising a clock face, a clock mechanism comprises:

a spindle located in the face and driven by the mechanism and rotatable hands mounted on the spindle to provide a time display; and a barometer mechanism comprising, a barometric sensor, drive means and drive shaft and a plurality of display members located behind the clock face, each member engaged to the drive shaft by a gear or pulley mechanism and rotatable by the shaft in response to a signal by the barometric sensor;

wherein the clock face includes an aperture, each display member being rotatable between a respective visible location wherein the display member may be observed through the aperture and a respective hidden location wherein the display member is concealed by the clock face;

wherein the gear or pulley mechanisms are adapted to successively move the display members between hidden and visible locations as the drive shaft rotates to provide a display characteristic of weather conditions associated with pressure conditions measured by the barometric sensor.

2. A barometer clock as claimed in claim 1, wherein the initial angular location and rate and direction of rotation of each display are selected so that continuous rotation of the shaft between a minimum pressure orientation and a maximum pressure orientation causes movement of the display members between successive hidden and visible locations to provide a constant variable display observable through the aperture in the clock face.

3. A barometer clock as claimed in claim 1, wherein each display member occupies a sector of the clock circumference.

4. A barometer clock as claimed in claim 1, wherein each display is annular.

5. A barometer clock as claimed in claim 1, wherein each sector has a leading edge brought into view as the display moves from a hidden to a visible location.

6. A barometer clock as claimed in claim 5, wherein the leading edge is shaped to form a silhouette of a weather feature.

7. A barometer clock as claimed in claim 1, comprising a multiplicity of displays arranged in overlying axially spaced relation on the drive shaft.

8. A barometer clock as claimed in claim 7, wherein the displays are laminar, having a decorated surface facing towards the aperture.

9. A barometer clock as claimed in claim 1, wherein the displays comprise annular portions mounted on a circular circumferential support.

10. A barometer clock as claimed in claim 1, wherein the drive mechanism comprises a planetary gear arrangement for each display member.

11. A barometer clock as claimed in claim 10, wherein the gear arrangement comprises a sun gear and one or two planetary gears engaging an orbital gear located on the annular surface of the display member.

12. A barometer clock as claimed in claim 1, further comprising a microprocessor and a memory, arranged to allocate a pressure signal from the barometric sensor into one of a plurality of bands.

13. A barometer clock as claimed in claim 12, wherein the microprocessor is arranged to measure pressure of specified time internally and to calculate changes between successive pressure signals.

14. A barometer clock as claimed in claim 12, wherein the memory is arranged to store successive pressure reading for a specified plurality of time intervals and wherein the microprocessor provides a signal indicative of the rate of change of pressure.

* * * * *